US007093661B2

(12) United States Patent
Olsen

(10) Patent No.: US 7,093,661 B2
(45) Date of Patent: Aug. 22, 2006

(54) SUBSEA PRODUCTION SYSTEM

(75) Inventor: Geir Inge Olsen, Oslo (NO)

(73) Assignee: Aker Kvaerner Subsea AS, Lysaker (NO)

( * ) Notice: Subject to any disclaimer, the term of this patent is extended or adjusted under 35 U.S.C. 154(b) by 199 days.

(21) Appl. No.: 10/239,490

(22) PCT Filed: Mar. 5, 2001

(86) PCT No.: PCT/NO01/00086

§ 371 (c)(1),
(2), (4) Date: Dec. 13, 2002

(87) PCT Pub. No.: WO01/71158

PCT Pub. Date: Sep. 27, 2001

(65) Prior Publication Data

US 2003/0145991 A1 Aug. 7, 2003

(30) Foreign Application Priority Data

Mar. 20, 2000 (NO) ..... 20001446

(51) Int. Cl.
*E21B 29/12* (2006.01)

(52) U.S. Cl. ..... 166/357; 166/267; 166/266; 210/110

(58) Field of Classification Search ..... 166/357, 166/265, 266, 267, 268, 52, 105.5, 105.6; 210/170, 747, 110
See application file for complete search history.

(56) References Cited

U.S. PATENT DOCUMENTS

| | | | | |
|---|---|---|---|---|
| 3,556,218 | A * | 1/1971 | Talley et al. | 166/265 |
| 3,562,014 | A | 2/1971 | Childers et al. | |
| 3,718,407 | A | 2/1973 | Newbrough | |
| 4,738,779 | A | 4/1988 | Carroll et al. | |
| 5,154,741 | A | 10/1992 | da Costa Filho | |
| 5,482,117 | A | 1/1996 | Kolpak et al. | |
| 5,711,374 | A | 1/1998 | Kjos | |
| 5,794,697 | A | 8/1998 | Wolflick et al. | |
| 5,857,715 | A | 1/1999 | Gray et al. | |
| 5,860,476 | A | 1/1999 | Kjos | |
| 5,988,275 | A * | 11/1999 | Brady et al. | 166/105.5 |
| 5,996,690 | A | 12/1999 | Shaw et al. | |
| 6,009,945 | A | 1/2000 | Ricks | |
| 6,032,737 | A * | 3/2000 | Brady et al. | 166/265 |
| 6,039,116 | A * | 3/2000 | Stevenson et al. | 166/263 |
| 6,158,508 | A | 12/2000 | Lemetayer et al. | |
| 6,189,613 | B1 * | 2/2001 | Chachula et al. | 166/265 |
| 6,189,614 | B1 * | 2/2001 | Brady et al. | 166/266 |
| 6,494,258 | B1 * | 12/2002 | Weingarten | 166/265 |
| 6,672,387 | B1 * | 1/2004 | Brady et al. | 166/266 |
| 6,691,781 | B1 * | 2/2004 | Grant et al. | 166/265 |

FOREIGN PATENT DOCUMENTS

| | | |
|---|---|---|
| EP | 0 583 912 A1 | 8/1993 |
| GB | 2 028 400 A | 3/1980 |
| GB | 2 257 449 A | 1/1993 |
| GB | 2 281 925 A | 3/1995 |

(Continued)

*Primary Examiner*—Thomas A Beach
(74) *Attorney, Agent, or Firm*—Knobbe, Martens, Olson & Bear LLP

(57) ABSTRACT

Methods and arrangements for production of petroleum products from a subsea well. The methods comprise control of a downhole separator, supplying power fluid to a downhole turbine/pump hydraulic converter, performing pigging of a subsea manifold, providing gas lift and performing three phase downhole separation. Arrangement for performing the methods are also described.

48 Claims, 24 Drawing Sheets

FOREIGN PATENT DOCUMENTS

| | | |
|---|---|---|
| GB | 2 326 895 | 1/1999 |
| GB | 2 346 936 | 8/2000 |
| NO | 933907 | 10/1993 |
| WO | WO 86/03143 | 6/1986 |
| WO | WO 89/12728 | 12/1989 |
| WO | WO 94/13930 | 6/1994 |
| WO | WO 95/08044 | 3/1995 |
| WO | WO 98/13579 | 4/1998 |
| WO | WO 98/37307 | 8/1998 |
| WO | WO 98/41304 | 9/1998 |
| WO | WO 00/14381 | 3/2000 |

* cited by examiner

SUBSEA PRODUCTION SYSTEM

RELATED APPLICATIONS

This application is a National Phase entry in the United States of the International Application No. PCT/NO01/00086, filed Mar. 5, 2001 and claims the benefit of the Norwegian Application 2000 1446, filed Mar. 20, 2000.

BACKGROUND OF THE INVENTION

1. Field of the Invention

The invention relates to a method of controlling a downhole separator for separating hydrocarbons and water such that the hydrocarbons leave the separator flowing through a x-mas tree and a first header in a manifold, where a power fluid is used to drive a downhole turbine/pump hydraulic converter, such that the pump in the downhole turbine/pump hydraulic converter pumps separated water, and where the power fluid for the downhole turbine/pump hydraulic converter is fed through a second header in the manifold, an adjustable valve and the x-mas tree to the turbine in the downhole turbine/pump hydraulic converter. The rate of pumping is controlled by the rate of power fluid based on measures of water level in the separator, a flow split, or oil and/or water entrainment of the separated phases.

2. Description of the Related Art

One of the largest cost savings potential in the offshore oil and natural gas production industry is the zero topside facilities concept. i.e. to place as much of the equipment used for producing hydrocarbons on the seabed or downhole. Ideally this would mean the direct transport of produced hydrocarbons from subsea fields to already existing offshore platforms or all the way to shore. To achieve this, several of the topside processes and the provision of various power supplies have to be moved subsea or downhole. This preferably includes separation to intermediately stabilized crude, provide dry gas and most important remove water to reduce pipeline transportation cost and reduce hydrate formation problems associated with long distance hydrocarbon transport. Further advantages may be achieved by utilising subsea single phase or multiphase pump, gas compressor and gas liquid separation.

To achieve the above, electric and hydraulic power has to be supplied from platform or shore and distributed to the various subsea consumers. Hydraulic power has to be made available locally at the subsea production unit to serve equipment at the seabed or downhole.

Water is almost always present in the rock formation where hydrocarbons are found. The reservoir will normally produce an increasing portion of water with increase time. Water generates several problems for the oil and gas production process. It influence the specific gravity of the crude flow by dead weight. It transports the elements that generate scaling in the flow path. It forms the basis for hydrate formation, and it increases the capacity requirements for flowlines and topside separation units. Hence, if water could be removed from the well flow even before it reaches the wellhead, several problems can be avoided. Furthermore, oil and gas production can be enhanced and oil accumulation can be increased since increased lift can be obtained with removal of the produced water fraction.

A downhole hydrocyclone based separation system can be applied for both vertically and horizontally drilled wells, and may be installed in any position. Use of liquid-liquid (oil-water) cyclone separation is only appropriate with higher water-cuts (typical with water continuous wellfluid). Water suitable for re-injection to the reservoir can be provided by such a system. Cyclones are associated with purifying one phase only, which will be the water-phase in a downhole application. Using a multistage separation cyclone separation system, such as described in pending Norwegian patent application NO 2000 0816 of the same applicant will reduce water entrainment in the oil phase. However, pure oil will normally not be achieved by use of cyclones. Furthermore, energy is taken from the well fluid and is consumed for setting up a centrifugal field within the cyclones, thereby creating a pressure drop.

A downhole gravity separator is associated with a well specially designed for its application. A horizontal or a slightly deviated section of the well will provide sufficient retention time and a stratified flow regime, required for oil and water to separate due to density difference.

The separated formation water can be directed up through the wellhead, but would be best disposed of by directly re-injecting it into a reservoir below the oil and/or gas layers, to stabilize and uphold the reservoir pressure in the oil formations. Until recently this has been done by injecting the water in a separate wellbore several kilometres away from the hydrocarbon producing well. However, since an increasing number of wells now are highly deviated and extending through a relatively thin oil and/or gas producing formation, the water may be injected in the same well, some distance from the oil and/or gas producing zone.

Both the cyclone type and the gravity downhole hydrocarbon separator can be combined with either Electrical Submersible Pumps (ESP's) or Hydraulic Submersible Pumps (HSP's). The use of ESP's have increased drastically over the last years, initially for shore based wells, then on offshore platform wells and finally over the last few years on subsea wells. The ESP's are primarily used for pressure boosting the well fluid, but is also applied with cyclone separators for re-injecting produced water and boosting the separated oil to the surface. The pump is driven by asynchrone alternating current utilizing variable frequency, drive provides a variable speed motor driving the pump. Hence, a variable pressure increase can be provided to the flow. This technology is currently improving and is applied in an ever-increasing amount of problem wells. The pump motors requires electric power to be provided from the platform to which the subsea system is connected, or from onshore. One ore more subsea cables are needed as well as a set of subsea, mateable high voltage electric connectors, depending on the number of pumps. Special arrangements have to be made to penetrate the wellhead, and the downhole cable has to be clamped to the production tubing during the well completion. The pump is installed as part of the tubing and hung off the tubing hanger in the x-mas tree. Pump installed by coiled tubing is also being introduced. Limited operational time of a downhole ESP is largely caused by failure in power cable, electrical connections and electrical motors.

The HSP is rotational equipment consisting of a hydraulic powered turbine mechanically driving a pump unit. It is compact and may transfer more power compared to what is currently available with use of ESP's. The rotational speed is very high, resulting in fewer stages and a more compact unit then typical for ESP. Even though the higher rotational speed makes the bearings more sensitive to solid particles. Use of more abrasive resistance materials counteracts this problem. The application of hydrostatic bearings and continuous lubricated bearings with clean fluid supplied from surface gives a hydraulic driven downhole pump extended time in operation in a downhole environment, compared with what is currently expected of an ESP. The HSP's may be installed in the well on the tubing, by coiled tubing or by wireline operation. The pump can be driven by a conventional hydraulic motor but more likely by a turbine.

A gas reservoir normally produced a dry gas into the well inflow zone. When reservoir pressure has depleted or when well draw-down is high condensate may be formed. Water may be drawn from pockets in the reservoir formation of from a gas-water interface in the formation. The energy required for lifting produced liquid to the seabed will result in a substantial pressure drop in the production tubing. Removing the water (and/or condensate) downhole for local injection may thus either be of benefit by achieving a higher production rate determined by a resulting lower wellbore flowing pressure. Alternatively, a lower production rate can provide higher wellhead pressure which can help increasing the possible tie-back distance of a subsea field development to an existing infrastructure.

When considerable volume of gas is present in the wellbore a oil-water separator will have reduced capacity and separation performance will decline. In this case an downhole gas-liquid separator can be built-in upstream the oil-water. A gravity separator may be used, but will be ineffective when liquid is in form of mist carried with the high velocity gas flow. A centrifugal type separator will have enhance performance and enable acceleration of the gas phase past the oil-water separator thereby minimizing flow area occupied by gas.

Certain reservoir conditions and infrastructures may require flow assistance to enable production of oil and gas, and transportation from the reservoir to a production facility, economically, over the life of a field and in the environment. Generally reservoir pressure, high crude specific gravity, high viscosity, deep water, deep reservoir, long tie-back distance and high water content could put different demands and requirements on the equipment used subsea. These demands and requirements may very often vary over time.

Gas lift is a well-known method to assist the flow. As gas is injected in the flow some distance below the wellhead the commingled gas and crude specific gravity is reduced, thus lowering the wellbore inflow pressure resulting in an increased inflow rate. As pressure is reduced higher up in the production tubing, further increasing the gas volume, the gravity is even more reduced, helping the flow considerably. The gas is normally injected inthe annulus through a pressure controlled inlet valve into the production tubing at a suitable elevation.

Another method to increase lift is by introducing a downhole pump, electrical or hydraulic powered, to boost the pressure in the production tubing. The pump should preferably be positioned at the bottom of the well where gas has not been released form the oil, thus providing better efficiency and preventing cavitation problems.

Using gas for gaining artificial lift will increase frictional pressure drop since total volume flow increases with gas being brought back to host. At long tie-back distances the net effect of using gas lift becomes low when gain in static pressure is reduced by increased dynamical pressure losses. However, downhole gas lift can be accomplished locally at the production area by separating and compressing a suitable rate of gas taken from the wellfluid and distributing to the subsea wells for injection. This re-cycling of gas reduces the amount of gas flowing in the pipeline compared to having gas supplied from the host. The advantage of this can be utilized by increasing production rate from the wells, reducing pipeline size or increasing capacity by having additional well producing via the pipeline. In addition to this gas life at the riserbase will become more effective with this process configuration.

A cluster type subsea production system is typically comprising individual satellite trees arrayed around and connected to a central manifold by individual flowline jumpers. A template subsea production system consists of a compact (closely arrayed), modular, and integrated drilling and production system, designed for heavy lift vessel or moonpool/drilling rig deployment/recovery with capability for early-well drilling, ultimately leading to early production. The system is generally associated with a four-well scenario, although larger templates of 6 or 8 slots are sometimes considered, depending on the overall system requirements. In most cases the template will be equipped with a production manifold consisting of two production headers and a pipe spool connecting the headers at one end. This will allow for round trip pigging operations. In case of only one production header is used, pigging operations will require a subsea pig launcher and/or a subsea pig receiver.

The main function of the manifold is to commingle the production into one or more flowlines connected to a topside production facility, which may be located directly above or several kilometers away from the manifold. The manifold is usually a discrete structure, which may be drilling-vessel deployed or heavy-lift vessel deployed, depending on size and weight.

The production branches are tied off from the production header to the manifold import hub via a system of valves, allowing production flow to be directed into one of the production headers, or an individual tree to be isolated from the header. Alternatively, all production may be routed to one flowline allowing for the other flowline to be utilized for service operations.

In some cases the production branches also include chokes. This is depending upon the control system philosophy. Typically, the manifold will include a manifold control module. The main purpose of this is to monitor pressure and temperature and control manifold valves. Other functions may also be included, such as pig detection, multiphase flowmeter interface, sand detection and valve position indication.

An alternative is also to include the tree control modules in the manifold. This may eliminate the need for a dedicated manifold control module, as the tree control modules can control and monitor manifold functions. Again this is dependent on the overall control philosophy, number of functions, and the step-out distance.

Removing water from the well fluid late in the production lift when reservoir pressure has declined and water content has increased facilitates a lessening of fluid transport pipeline capacity. Electrical power is normally supplied to the subsea pumps via individual cables. Power may alternatively be supplied from a subsea power distribution system with a single AC or DC cable connected to the host. Hydraulic oil, chemicals, methanol and control signals are communicated to the subsea installation by use of a service umbilical. In case of using one flowline only, it can be integrated into the service umbilical together with the electrical cables providing a single flexible connection between the subsea production system and host facility. This combination may have a major cost reduction impact, especially for very long tie back distances.

Power fluid supplied subsea can also be utilized to provide downhole pressure boosting of the separated oil phase from the separator. Pressure boosting may also be by boosting the wellfluid flowing into the separator. Both ESP's and HSP's can be used to lower the wellbore flowing pressure and thereby increasing the inflow rate from the reservoir.

The conventional and Side Valve Trees have a basic philosophical difference in the sequence of installing the tubing completion. The conventional system is normally thought of for the drilling and completion scenario, which means that the tubing hanger is installed into the wellhead immediately after installation of the casing strings. This is done while the BOP (Blow-out Preventer) stack is still connected to the wellhead. The tree is then installed on the completed wellhead with a dedicated, open water riser system. Flowlines are then connected to the tree. This tends to be very efficient when it is known that a well will be completed. The down side of the conventional tree system is that any workover of the wellbore, where the completion is recovered, involves recovery of the tree. This means that flowlines and umbilical connectors, along with jumpers, must be disconnected prior to tree recovery. The tree is recovered with the dedicated riser system, then the BOP system is installed on the wellhead and only then the completion can be recovered.

A dual function x-mas tree is utilized when it is desirable to inject and produce through the same tree/wellhead. The advantage to this case is the elimination of drilling a dedicated injection well.

Downhole pressure control is required in the form of downhole safety valves. Both the inner and outer strings require safety valves. The inner string could be production or injection, and the second string (outer) would be injection. Further, if two sets of DHSV's (Downhole Safety Valves) are used then it will be assumed that each valve (inner and outer) will be controlled on an individual hydraulic function. The Horizontal Side Valve Tree provides the best solution for this configuration. The main reason for this is the advantage of being able to pull the downhole completion through the tree, which is not possible in the case of conventional trees.

The Side Valve Tree (SVT) is normally intended for a batch drilling scenario, or when planned workovers are anticipated. The SVT also is used when artificial lift means are incorporated, Such as an Electrical Submerged Pump (ESP) is either planned or used later in the field life. Vertical access is accomplished using a Blow-Out Prevention (BOP) system, or other dedicated system. Since the valves are located on the side of the spool, full bore access (usually 18¾" diameter) is achieved. Flowlines are not disturbed during any of the workover interventions. In essence, the SVT becomes a tubing spool and the completion is installed into this spool. The down side of the SVT system is that the BOP stack must be recovered between drilling the casing and drilling the completion. The SVT is landed on the wellhead, and the BOP is re-installed on top of the SVT.

The Independently Retrievable Tree (IRT), currently being developed, combines the most desirable features of the conventional x-mas tree and the SVT. This type of tree is considered a true through-bore tree. Simply stated, the IRT allows recovery of either the tree or the tubing hanger independent of each other. Installation order of this system is also independent of each other. This means that the tubing hanger can be installed as in a conventional system, and then install the tree. The system also allows for installation of the tree first, like the SVT system, then install the completion. This type of design provides for maximum flexibility compared with the previous systems. When more equipment being installed downhole the need for regular retrieval of the completion increases, which favours the Side Valve and IR Tree.

The use of a standard production Side Valve Tree in combination with an injection spool would be considered a highly feasible solution. This solution utilizes existing technologies for the primary equipment. Tubing spools are frequently used in subsea wellhead production equipment as an alternative means for tubing hanger support. This "stacked" tree arrangement would be much the same as a tree-on-tubing spool configuration. This solution utilizes existing technologies for the primary equipment. An increased number of penetrations are required for wellbore control. Additional penetrations are an expansion of current technology, which is considered both feasible and mature.

SUMMARY OF THE INVENTION

The present invention takes advantage of the newest developments in tree technology, to make it possible to produce and inject (including power fluid supply) through the same x-mas tree. However, the present invention is not limited to the use of the above mentioned trees, since it is also possible to realise the invention through more conventional technology.

The main object of the present invention is to facilitate the supply of power fluid to downhole turbines or engines in a plurality of wells, and further facilitate the control of downhole separators.

A further object of the present invention is to enable an accommodation of the equipment to the changing requirement over the lifespan of the well, e.g. enable transportation of produced hydrocarbons in both headers in the beginning of the lifespan and enable water injection through one header when the wells are producing increasingly larger ratios of water.

Another object of the present invention is to reduce costs by reducing the need for equipment, and thereby also reducing the installation costs and service costs.

A further object of the present invention is to make it possible to use only one flowline coupled to the subsea manifold, whilst still retaining the possibility of supplying power fluid to turbines in the wells.

Still another object of the present invention is to enable round pigging (for cleaning and/or monitoring) in a single flowline connected to a manifold.

This is achieved according to the invention by the characterizing features of the enclosed claims 1, 3, 9, 28, 31 and/or 35.

The independent claims are defining further embodiments and alternatives of the invention.

BRIEF DESCRIPTION OF THE DRAWINGS

A detailed description of the present invention is to be made, as an example only, under reference to the embodiments shown in the enclosed drawings, wherein.

DETAILED DESCRIPTION OF THE PREFERRED EMBODIMENTS

For the description of all embodiments hereafter the features corresponding fully with the previous embodiment, or embodiment referred to, is not described in detail. It is to be understood that the parts of the embodiment not described in detail fully complies with the previous embodiment or any other embodiment referred to.

When in the following specification the term well fluid is used, this means the fluid that is extracted from the formation. The well fluid may contain gas, oil and/or water, or any combinations of these. When in the following specification the term production fluid is used, this means the portion of the well fluid that is brought from the reservoir to the seabed.

Figure 1A:
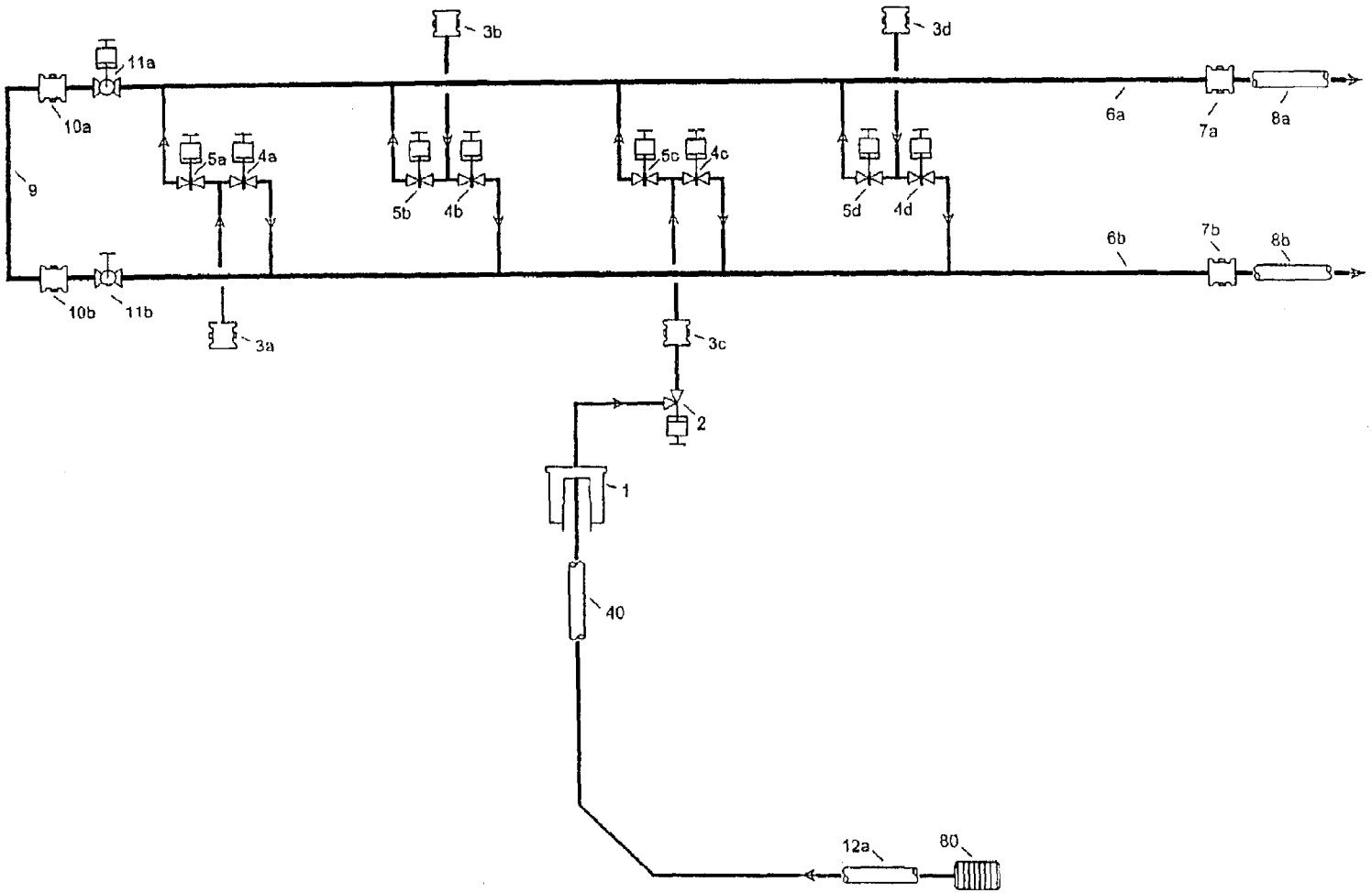
FIG. 1*a* shows a process flow diagram of a conventional layout of a production manifold and well according to prior art.

FIG. 1*a* illustrates a prior art production situation layout with four wells, each connected to the manifold by mechanical connectors 3*a*, 3*b*, 3*c*, 3*d*. For illustration the well connected to the mechanical connector 3*c* the layout is displayed in detail. However, it should be understood that the layouts for the other four wells are of a similar kind.

The well connected to the mechanical connector 3*c* comprises a downhole production tubing 40 (only partly shown), leading to a petroleum producing formation 80, a subsea wellhead 1 and a production choke 2. The production choke is, via the mechanical connector, in communication with a manifold, generally denoted 41.

The manifold comprises two production headers 6*a* and 6*b*. A set of isolation valves 4*a*, 5*a*; 4*b*, 5*b*; 4*c*, 5*c*; 4*d*, 5*d* for each well are provided to make it possible to route production flow into one or the other of the headers 6*a* and 6*b*.

Figure 1B:
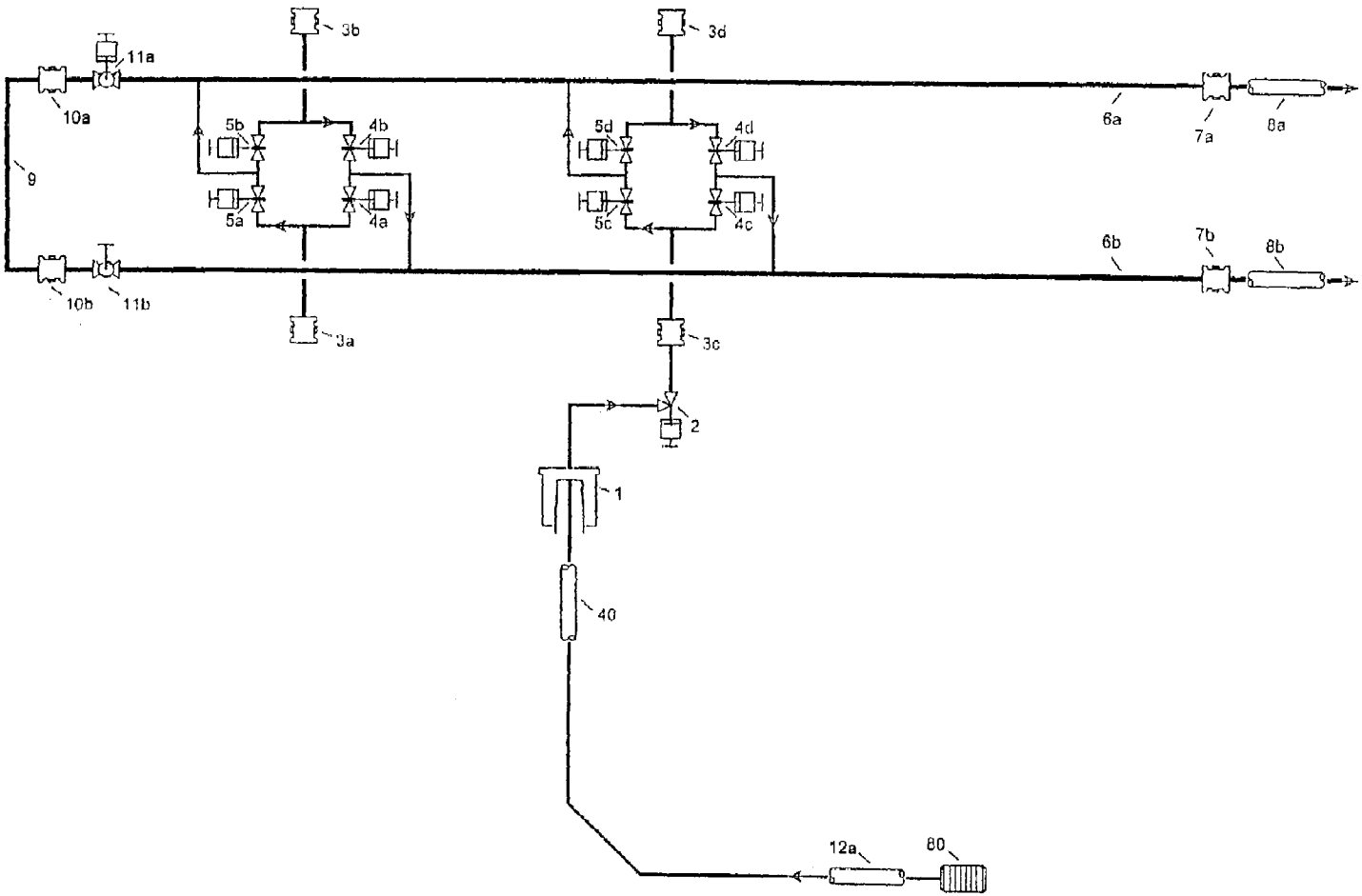
FIG. 1*b* illustrates an alternative isolation valve configuration to what is shown in FIG. 1*a*. The manifold has reduced number of connections between producing wells and manifold headers. Valves for routing production to each of the headers are grouped together for two wells.

At one end of the manifold a removable pipe spool 9 joints together the two headers 6*a*, 6*b* via two mechanical connectors 10*a*, 10*b*. An hydraulic operated isolation valve 11*a* is provided in the first header 6*a* and together with a ROV valve 11*b* in the second header enables removal of the pipe spool when closed for tie-in of another production template FIG. 1*b* show a deviated layout of the layout shown in FIG. 1*a*. Here two and two wells are coupled together to the manifold. As in FIG. 1*a* connector 3*a* is connected to the first header 6*a* via isolation valve 5*a*, and to the second header 6*b* via isolation valve 4*a*, connector 3*b* is connected to the first header 6*a* via isolation valve 5*b*, and to the second header 6*b* via isolation valve 4*b*. Opposite to the layout of FIG. 1*a*, isolation valves 5*a* and 5*b* are connected with each other, and isolation valves 4*a* and 4*b* are connected with each other. This layout makes it possible to choose which of the headers 6*a* and 6*b* the connectors are to be in communication with. Opening valves 5*a* and 4*b*, and closing valves 5*b* and 4*a* will set connector 3*a* in communication with the first header 6*a* and connector 3*b* in communication with the second header 6*b*. Opening valves 4*a* and 5*b*, and closing valves 4*b* and 5*a* will set connector 3*a* in communication with the second header 6*b* and connector 3*b* in communication with the first header 6*a*. Connectors 3*c* and 3*d* are connected to the manifold through valves 4*c*, 4*d*, 5*c*, 5*d* in a similar way as connectors 3*a* and 3*b*. In all other respects the two layouts of FIGS. 1*a* and 1*b* are similar.

The manifolds according to FIGS. 1*a* and 1*b* works in the following way:

Oil, gas and water flows from the reservoir into the wells and through the production tubing 40 to the subsea wellhead 1, and is routed to the manifold 41 via the production choke 2 and the mechanical connector 3*c*. One of the isolation valves 4*c*, 5*c* will be closed and the other one will be open and allow for production to be routed into either the first 6*a* or to the second header 6*b*. The production is then transported by natural flow to topsides or shore in flowlines 8*a*. 8*b* connected to the manifold 41 by mechanical tie-in connectors 7*a*, 7*b*.

It is possible also to bring in production fluids from another manifold by connecting this to the manifold instead of the pipe spool. The isolation valve 11 fitted in the first header enables the other header to be freed up to act as a service line.

Figure 2A:
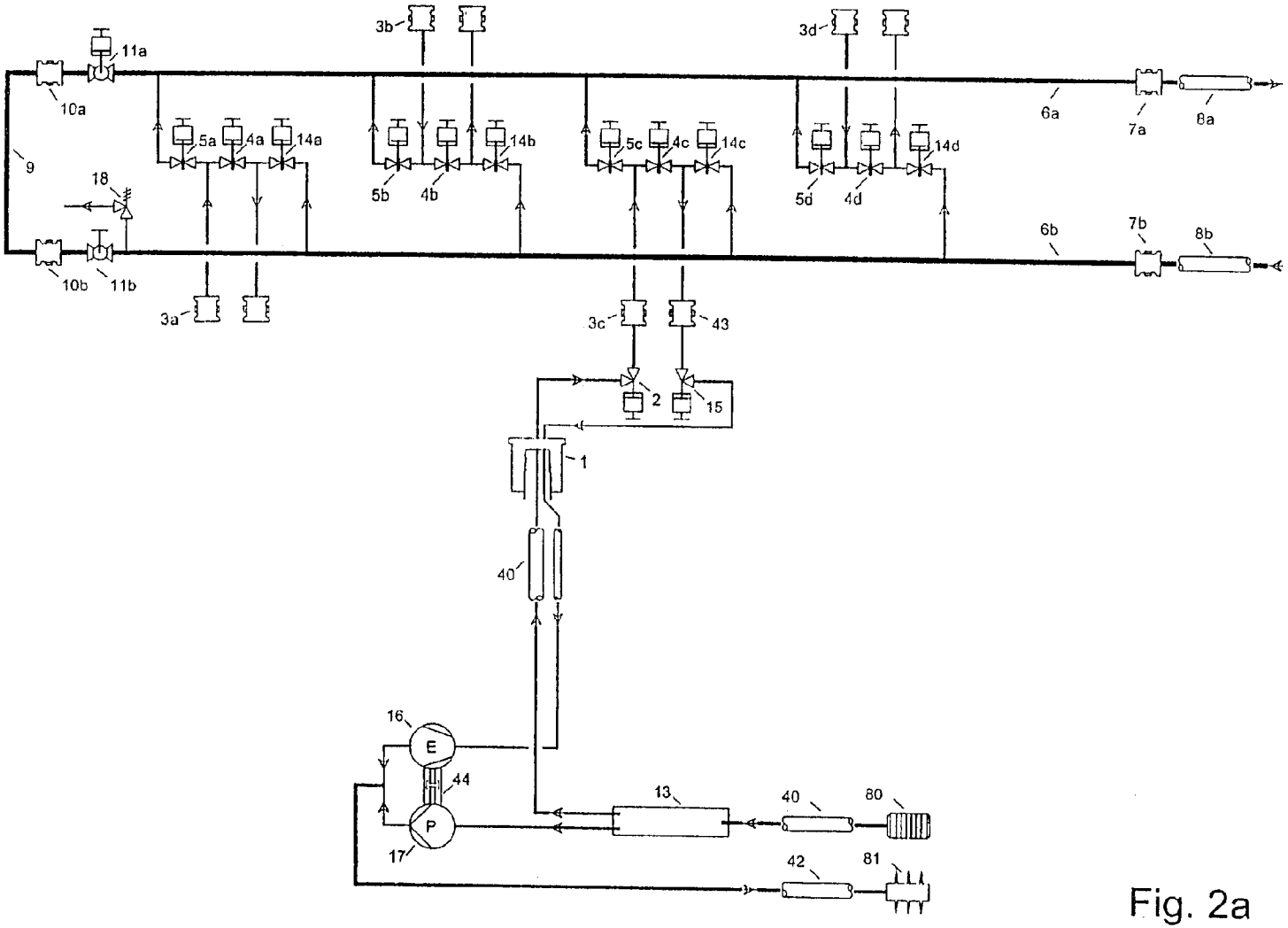
FIG. 2*a* shows a layout of a production manifold and well according to a first embodiment of the present invention, showing power water supplied from a platform or from the shore.

FIG. 2*a* shows a first embodiment of the present invention, which is a development of the manifold and well layout shown in FIG. 1. In addition to the isolation valves 4*a*, 5*a*; 4*b*, 5*b*; 4*c*, 5*c*; 4*d*, 5*d* it comprises a third isolation valve 14*a*, 14*b*, 14*c*, 14*d* for each well. A relief valve 18 is also provided.

A different layout is shown for the well connected to the mechanical connector 3*c*. The well comprises a production pipeline 40, which is connected to a downhole hydrocarbon-water separator 13. It also comprises an injection pipeline 42 connected to the separator via a downhole pump 17. The downhole pump 17 is driven by a downhole turbine expander 16. The turbine 16 is connected to the manifold via the wellhead (x-mas tree) 1, an injection choke 15 and a second mechanical connector 43.

In all other respects the layout of FIG. 2*a* is identical with the layout of FIG. 1*a*.

FIG. 2*a* illustrates the concept of combining hydrocarbon production and supply of power fluid (water) to one (or several) downhole located hydraulic turbine/pump converter(s). Wellfluid from the production reservoir 80 is via the production tubing routed to the downhole hydrocarbon-water separator 13. In the separator the hydrocarbons are separated from the water. Such a separator is known from e.g. WO 98/41304, and will therefore not be explained in detail herein. Hydrocarbons from the separator flows to the subsea production x-mas tree 1. Adjustment of the production choke 2 allows for individual control of production of the well producing to a common header 6*a*. All production fluids from the wells are routed to the first header 6*a* by setting the isolating valves 5*a*, 5*b*, 5*c*, 5*d* in open position and the isolating-valves 4*a*, 4*b*, 4*c* 4*d* in closed position.

The isolating valve 11 in the first header 6*a* is set to closed position, thus forcing all produced hydrocarbons to flow via the first flowline 8*a* to a platform or to shore for further processing.

Pressurized power fluid (water) is routed via the second flowline 8*b* to the manifold 41 and into the second header 6*b*. The isolating valves 14*a*, 14*b*, 14*c*, 14*d* are set in open position and allows power fluid to be routed from the second header 6*b* via the injection choke valve 15 to the injection side of the x-mas tree 1, which is of a dual function type (suitable for both production and injection). A production system may also consist of one or more well not having a downhole separator. In such a case the valve 14 is not relevant.

The power fluid is routed to the downhole turbine expander 16 either via the annulus formed by the production casing and the production tubing or by a separate injection tubing in a dual completion system. Water separated from the hydrocarbons in the downhole separator 13 is routed to a downhole pump 17. This pump is mechanically driven by the turbine, e.g. via a shaft 44. Power fluid expand to the pressure on the discharge side of the pump 16 where it is commingled with the separated, produced water and routed into the injection line to be disposed in a reservoir 81 suitable for water disposal and/or pressure support.

The rate of power fluid supplied to the turbine is regulated by operating the seabed located injection choke 15. For application with a gravity type downhole separator 13 a suitable rate of power fluid is applied in order to maintain a pre-set oil-water interface level and/or measurement of injection water quality. If a hydrocyclone type downhole separator is used, this is controlled by either flow-split (ratio between overflow and inflow rates) or by water-cut measurement in the hydrocarbon outlet. The total rate of power fluid supplied to the second header 6*b* is regulated to obtain a pre-set constant pressure in the second header 6*b*. The relief valve 18 may, if required, be integrated into the header 6*b* enabling surplus fluid to be discharged to the surrounding seawater.

The manifold and well of FIG. 2*a* may also be configured to produce hydrocarbons in a conventional way without injection. By closing the isolating valves 14*a*, 14*b*, 14*c*, 14*d* the injection will be cut off. By opening the isolating valves 4*a*, 4*b*, 4*c*, 4*d*, production fluid will be lead into the second header 6*b*, and production will take place in the same conventional way as in FIG. 1*a*.

Figure 2B:
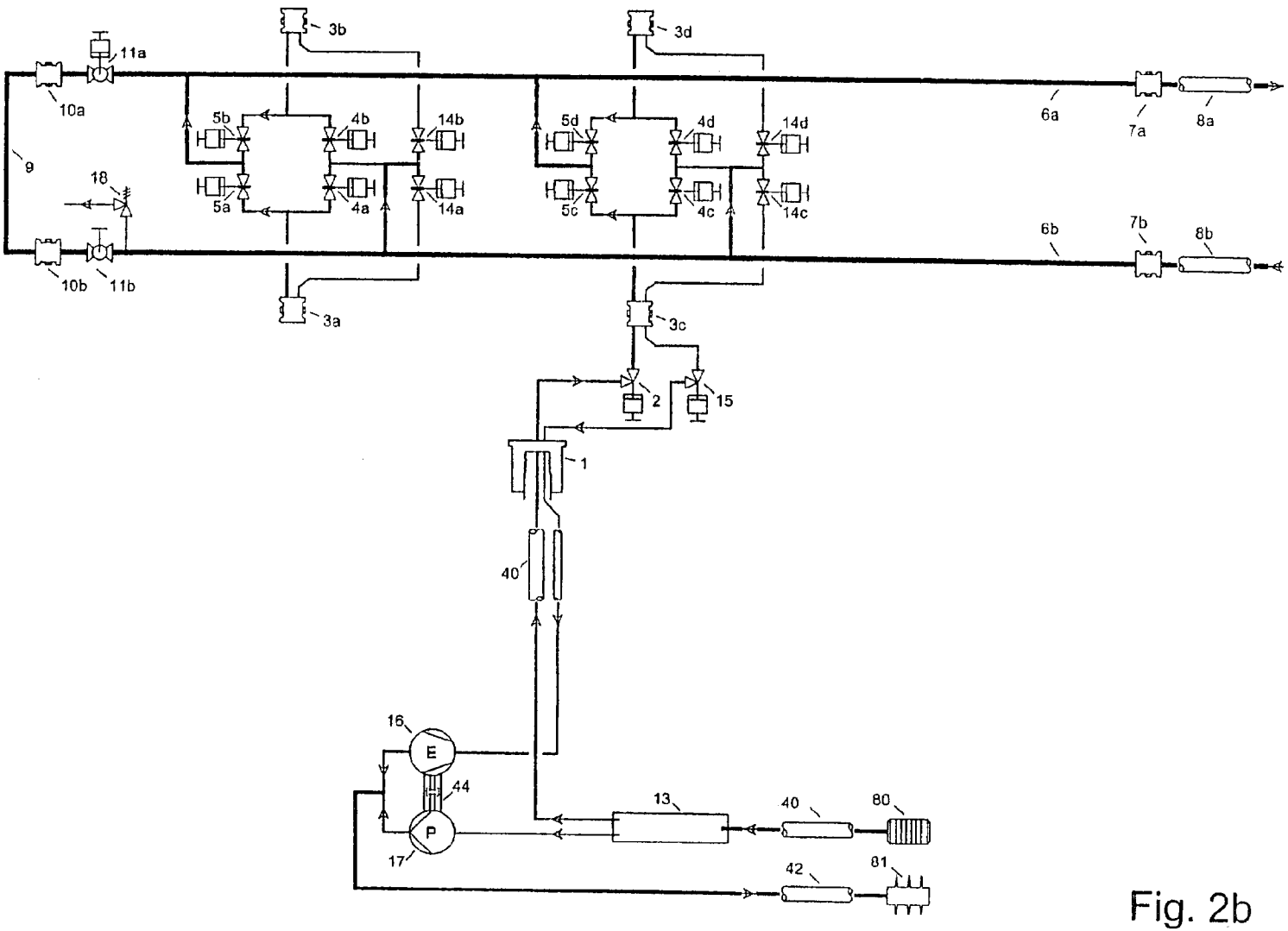
FIG. 2*b* illustrates an alternative configuration to what is shown in FIG. 2*a*. and similar to what is shown in FIG. 1*b*.

FIG. 2*b* show a deviated layout from FIG. 2*a*. The arrangement of connectors 3*a*, 3*b*, 3*c*, 3*d*, valves 4*a*, 4*b*, 4*c*, 4*d*, 5*a*, 5*b*, 5*c*, 5*d* and their connection to the first header 6*a* and the second header 6*b* is the same as in FIG. 1*b*. In addition to this the valves 14*a* and 14*b* are connected to each other and to the line between valves 4*a* and 4*b*. The valves 14*c* and 14*d* are connected to each other and valves 4*c* and 4*d* in a similar way. The second connector 43 is replaced with a common connector 3*c* for the production fluid line 40 and the power fluid line. I all other respects the layout of FIG. 2*b* is identical to the layout of FIG. 2*a*. Supply of power fluid is branched off from the isolation valve arrangement, with isolation valves 4*d* and 5*d* closed, routed to the x-mas trees via valves 14*c* and a multi bore connector 3*c*.

Figure 2C:
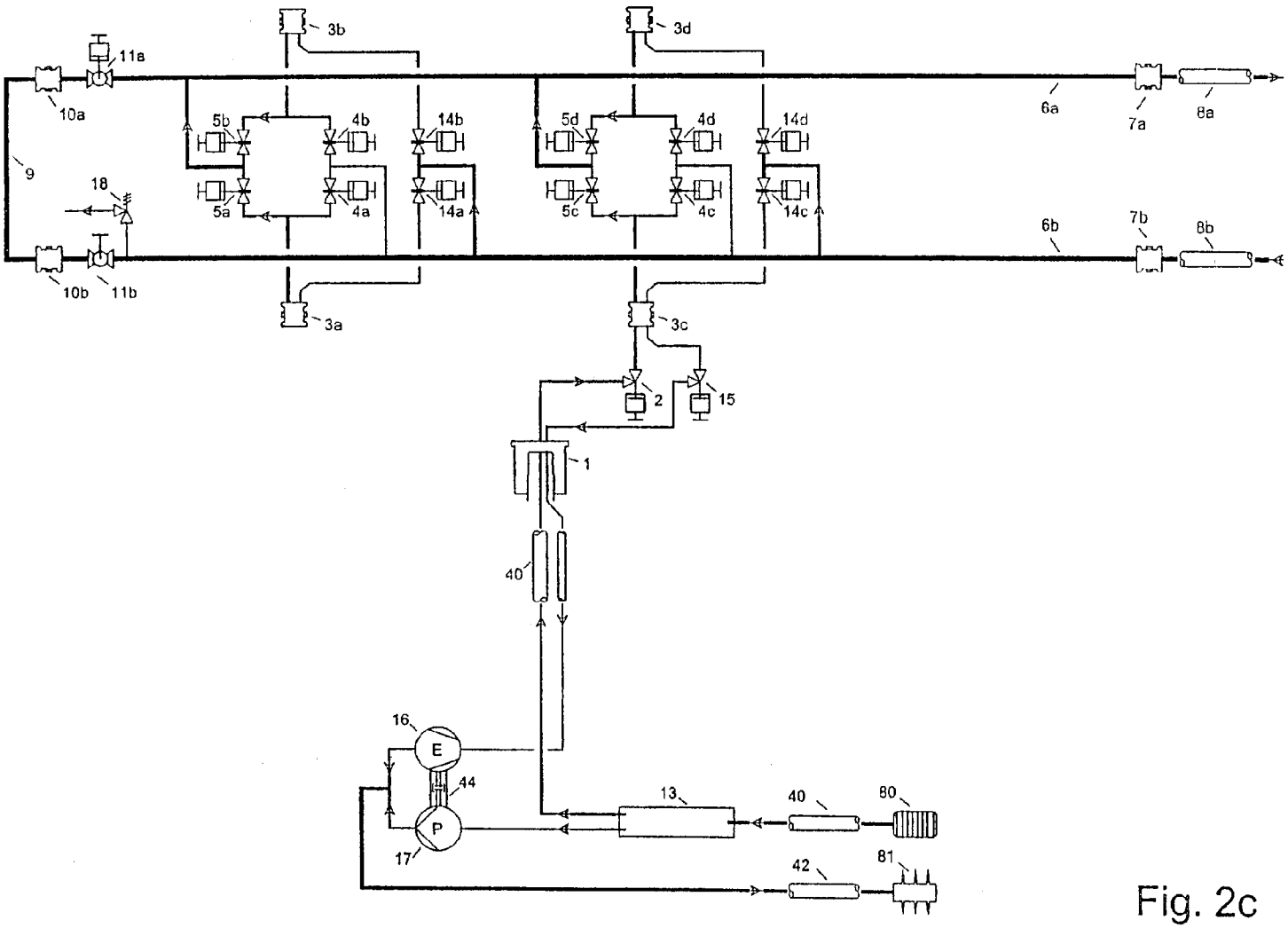
FIG. 2*c* illustrates an alternative configuration with arrangement of isolation valves similar to what is show in FIG. 2*b*.

FIG. 2*c* is a further deviation of the layout of FIG. 2*b*. Here the valves 14*a* and 14*b* are connected to each other, but not to the line between valves 4*a* and 4*b*. The same applies for valves 14*c* and 14*d*. In all other respects the layout of FIG. 2*c* is identical to the layout of FIG. 2*b*. Power fluid is supplied from pipe connection to the second header 6*b* and routed via the valves 14*a*, 14*b*, 14*c*, 4*d* and a multi bore connector to the wells.

Figure 3:
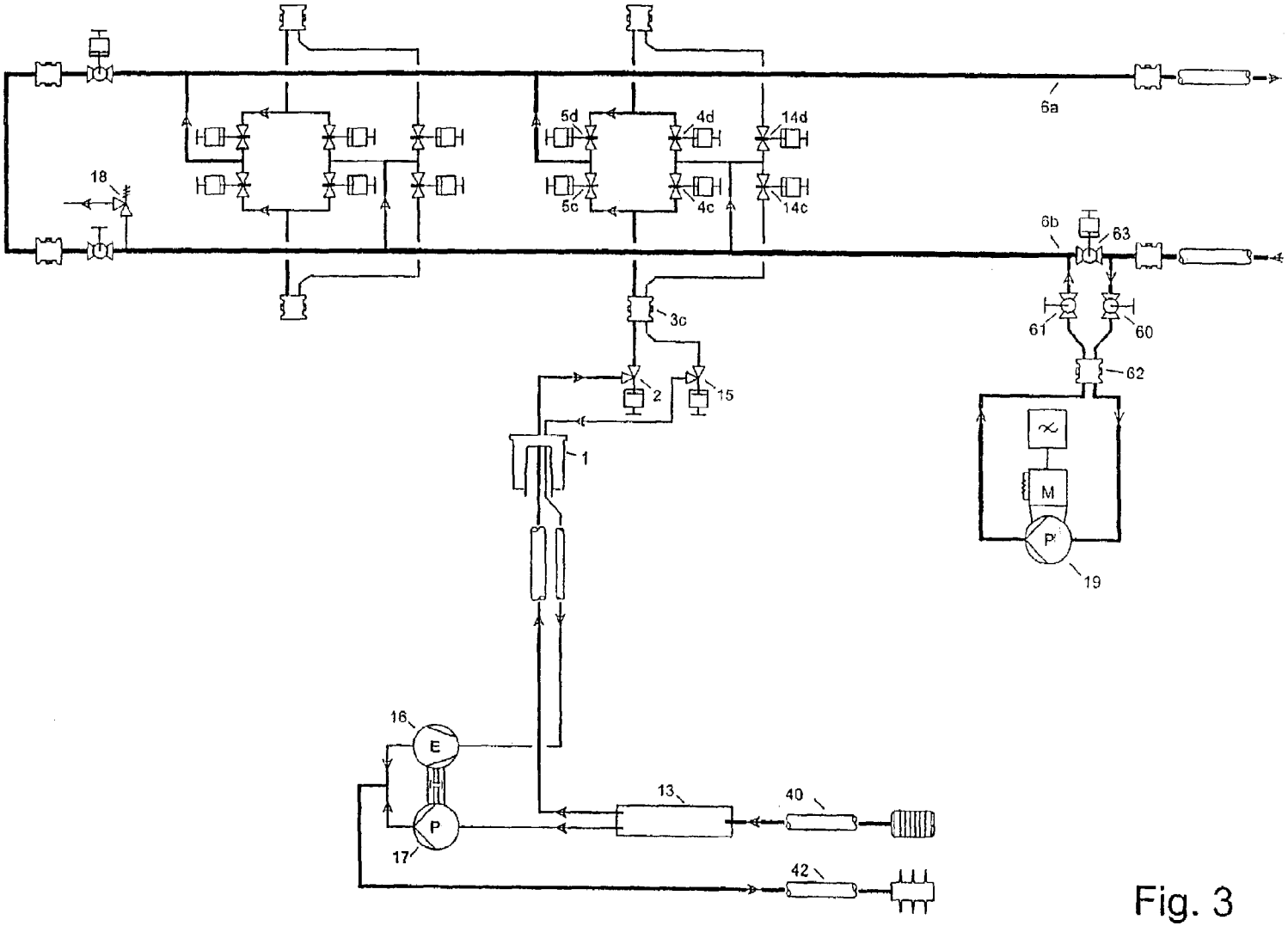
FIG. 3 shows a layout of a production manifold and well according to a second embodiment of the present invention, showing a diversion of the embodiment of FIG. 2*b*, with a charge pump.

FIG. 3 is a variant embodiment of FIG. 2*b* and illustrates the concept of utilizing a subsea located speed controlled charge pump 19. Power fluid may be supplied from a platform, shore or other subsea installations. The pump is connected to the second header via an inlet side shutoff valve 60, a discharge side shutoff valve 61 and a connector 62. A bypass valve 63 is also provided to enable bypass of power fluid passed the charge pump 19. The pump 19 shown is driven electrically, but may also be driven by any other suitable means.

Also here conventional production according to FIG. 1*a* may be achieved by closing the isolation valves 14*a*, 14*b*, 14*c*, 14*d* and opening the isolating valves 4*a*, 4*b*, 4*c*, 4*d*.

The bypass valve 63 will in such a case be open, to bypass the production fluids passed the pump 19.

Figure 4A:
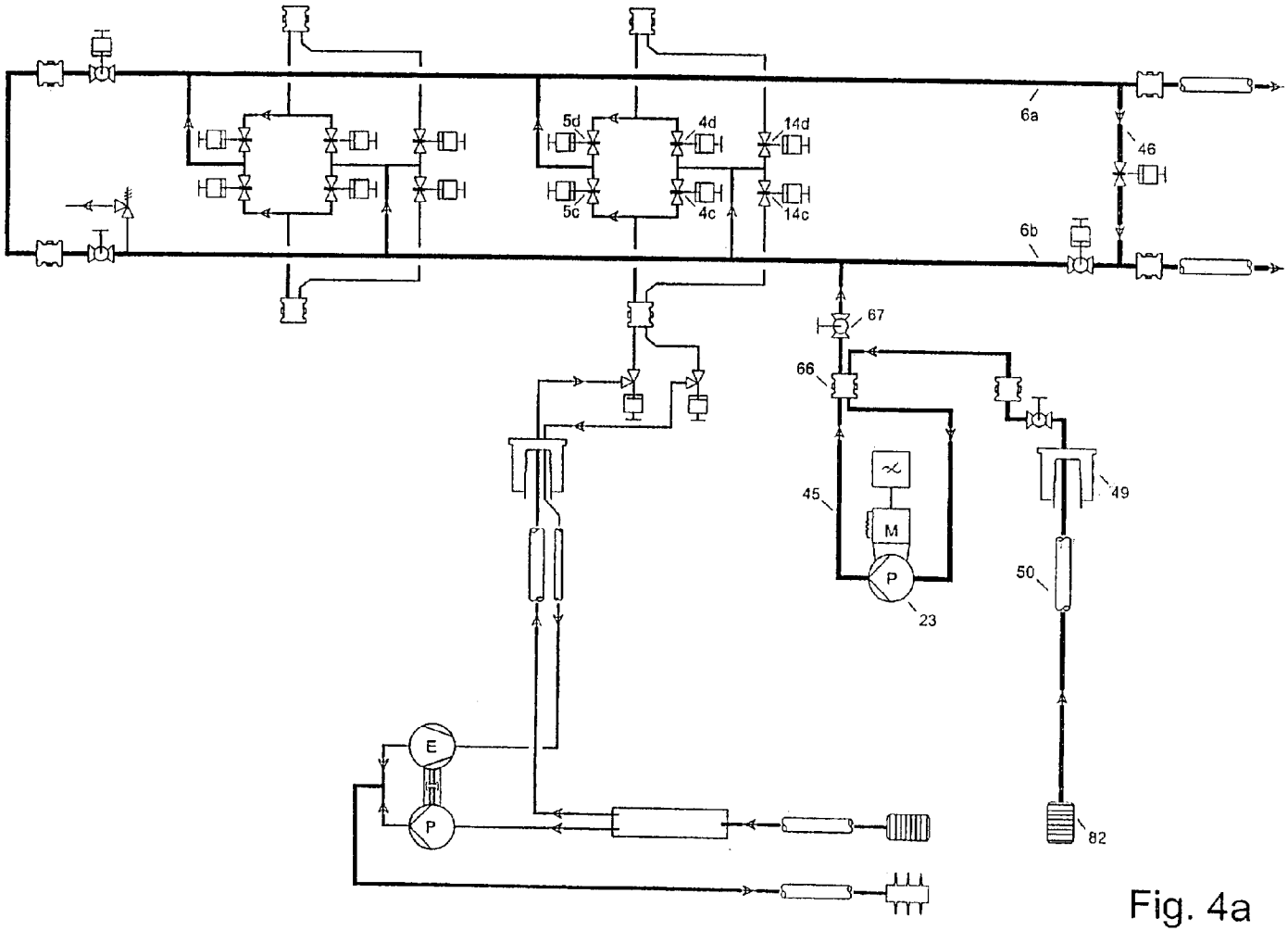
FIG. 4*a* shows a layout of a production manifold and well according to a fourth embodiment of the present invention, showing power water supplied from a free flowing water producing well.

FIG. 4*a* is a further embodiment and illustrates the application of a subsea located speed controlled pump 23 connected to the second header 6*b* within the manifold 41 supplying power fluid as free flowing water taken from a downhole aquifer 82, via a formation water line 50, a water production x-mas tree 49, a pipeline 45, a connector 66 and a shutoff valve 67. The charge pump 23 is utilized for power supply to the downhole turbine 16. The charge pump 23 is shown electrically driven, but may also be driven by any other suitable means. An isolation valve 21 is placed in the second header 6*b* and when closed prevent power fluid from entering the connected flowline 8*b*. A crossover pipe spool 46 with an isolation valve 22 connects the two headers 6*a*, 6*b*. With this valve in open position produced hydrocarbons can be routed from the first header 6*a* into both flowlines 8*a*, 8*b*.

Also here conventional production according to figure la may be achieved by closing the isolation valves 14*a*, 14*b*, 14*c*, 14*d* and opening the isolating valves 4*a*, 4*b*, 4*c*, 4*d*. The isolation valve 67 will be closed to avoid production fluid entering the pump 23.

Figure 4B:
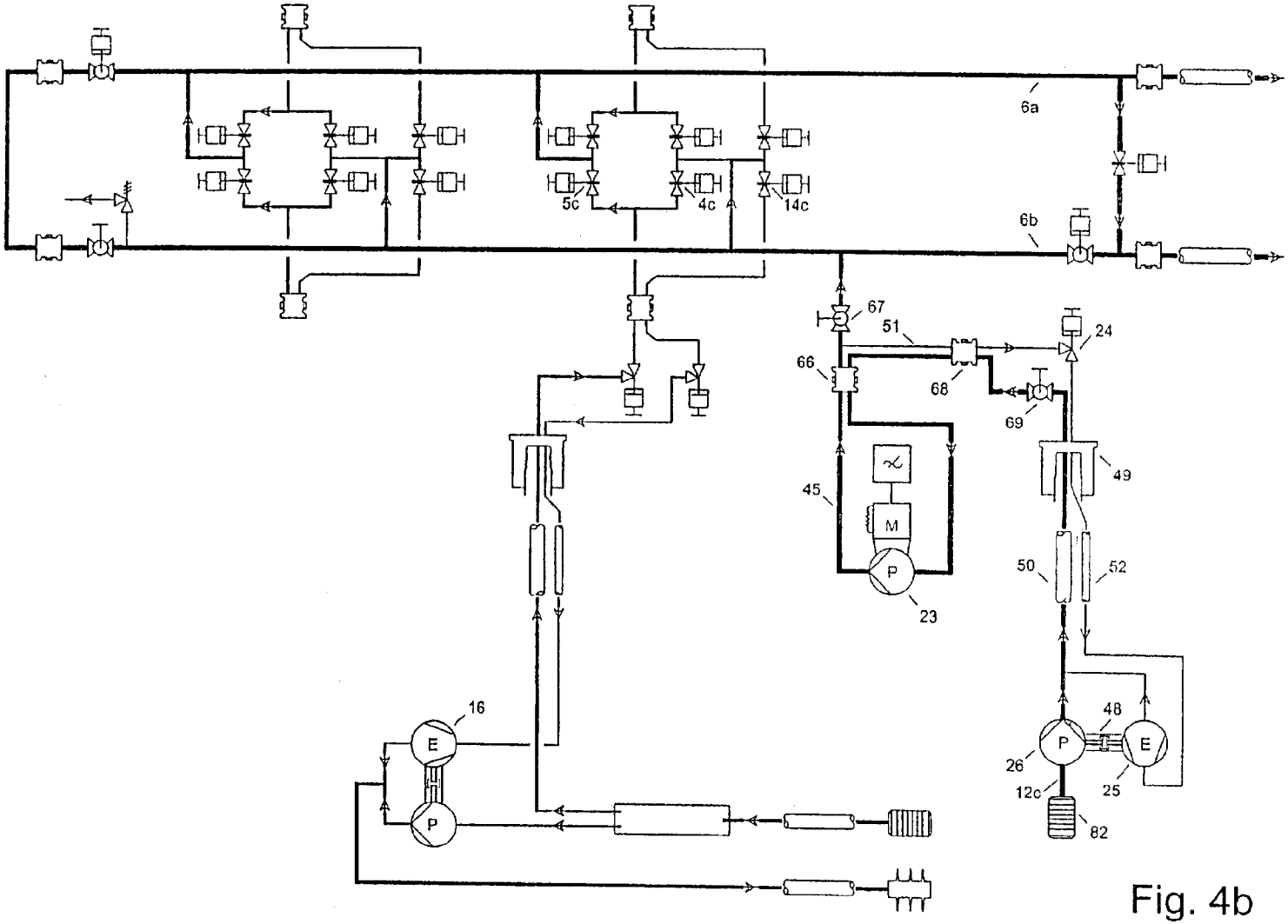
FIG. 4*b* shows a layout of a production manifold and well according to a fifth embodiment of the present invention, showing power water supplied by a pump in a water producing well.

FIG. 4*b* illustrates the same concept as outlined in FIG. 4*a*, with water supplied from a downhole aquifer 82. The water retrieving system comprises a downhole pump 26, driven by a downhole turbine 25 via a shaft 48. The turbine is fed with power fluid via a power fluid line 52, which is supplied via a choke valve 24.

The pump 26 feeds formation water to the seabed via a formation water line 50 and a water production x-mas tree 49. The water is pressurized by a subsea located speed controlled pump 23 connected to the second header 6*b* via the connector 66 and the shutoff valve 67, and connected to the formation water line via connector 66, a second connector 68 and a second shutoff valve 69.

A split flow is taken from the discharge side of the subsea charge pump 23 at 51 and routed to the downhole turbine 25 via the choke valve 24 located at the x-mas tree 49. The downhole turbine 25 drives the downhole pump 26 as the power fluid expands to the pump discharge pressure at the discharge side of the pump 26, where it is commingled with the formation water and brought to the seabed where the fluid again is utilized as power fluid to the production wells. This alternative is suited when mixing, of seawater and produced water will cause problems, for example scaling.

Also here conventional production according to FIG. 1*a* may be achieved by closing the isolation valves 14*a*, 14*b*, 14*c*, 14*d* and opening the isolating valves 4*a*, 4*b*, 4*c*, 4*d*. The isolation valve 67 will be closed to avoid production fluid entering-the pump 23 or the turbine 25. The choke valve 24 may also be in a closed position.

Figure 4C:
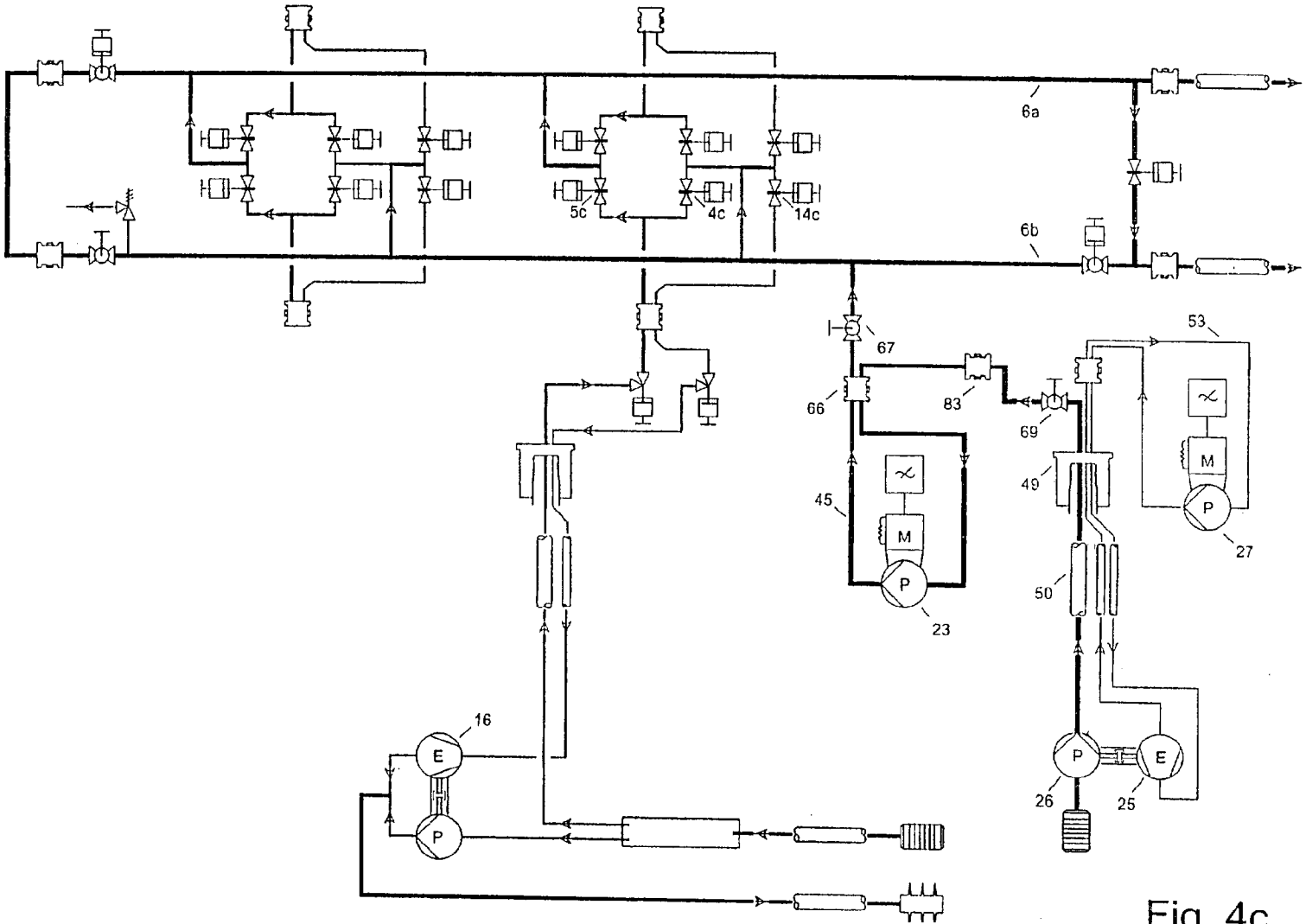
FIG. 4*c* shows a layout of a production manifold and well according to a sixth embodiment of the present invention, showing a diversion of the embodiment of FIG. 4*b*, with a closed circuit driven hydraulic powered pump for lift in the water producing well.

FIG. 4*c* illustrates a variant of the concept described in FIG. 4*b*. Here a closed loop system 53 for power fluid to the downhole turbine 25/pump 26 hydraulic converter is utilized. A charge pump 27 in the closed loop system 53 is electrically powered, speed controlled and is located at the seabed and integrated into the subsea production system.

The subsea charge pump 23 may be omitted if sufficient flow and pressure can be generated in the second header 6*b* by use of the formation water supply pump 26 only. The water supply pump 26 may also be driven electrically instead of by a power fluid driven turbine.

Also here conventional production according to FIG. 1*a* may be achieved by closing the isolation valved 14*a*, 14*b*, 14*c*, 14*d* and opening the isolating valves 4*a*, 4*b*, 4*c*, 4*d*. The isolation valve 67 will be closed to avoid production fluid entering the pump 23 or the turbine 25.

Figure 4D:
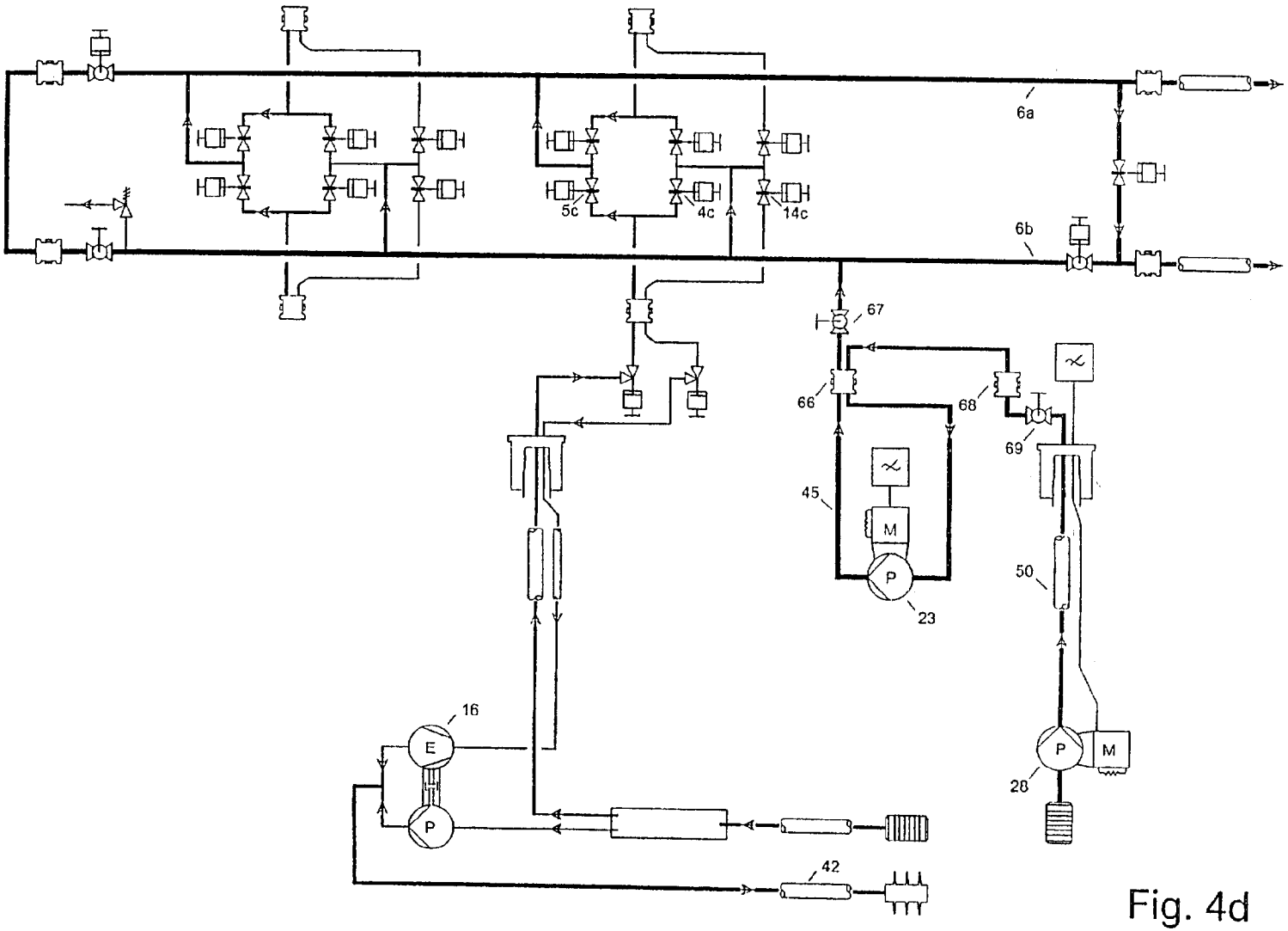
FIG. 4*d* shows a layout of a production manifold and well according to a seventh embodiment of the present invention, showing a diversion of the embodiment of FIG. 4*b*, with an electrically driven pump for lift in the water producing well.

FIG. 4*d* illustrates a concept with formation water supplied from an aquifer 82 by use of an electrically driven submerged pump 28 (ESP) The ESP is located downhole and provides sufficient pressure of the pumped fluid for the suction side of the charge pump 23 located on the seabed. For particular applications (especially for deepwater developments) formation water may be drawn from an aquifer and delivered to the seabed at acceptable charge pump suction pressure without need of downhole pressure boosting.

Like in the embodiment of FIG. 4*c* the charge pump is connected to the second header 6*b* via a connector 66 and a shutoff valve 67, and to the formation water line 50 via the connector 66 and a shutoff valve 69.

Also here conventional production according to FIG. 1*a* may be achieved by closing the isolation valves 14*a*, 14*b*, 14*c*, 14*d* and opening the isolating valves 4*a*, 4*b*, 4*c*, 4*d*. The isolation valve 67 will be closed to avoid production fluid entering the pump 23.

Figure 5A:
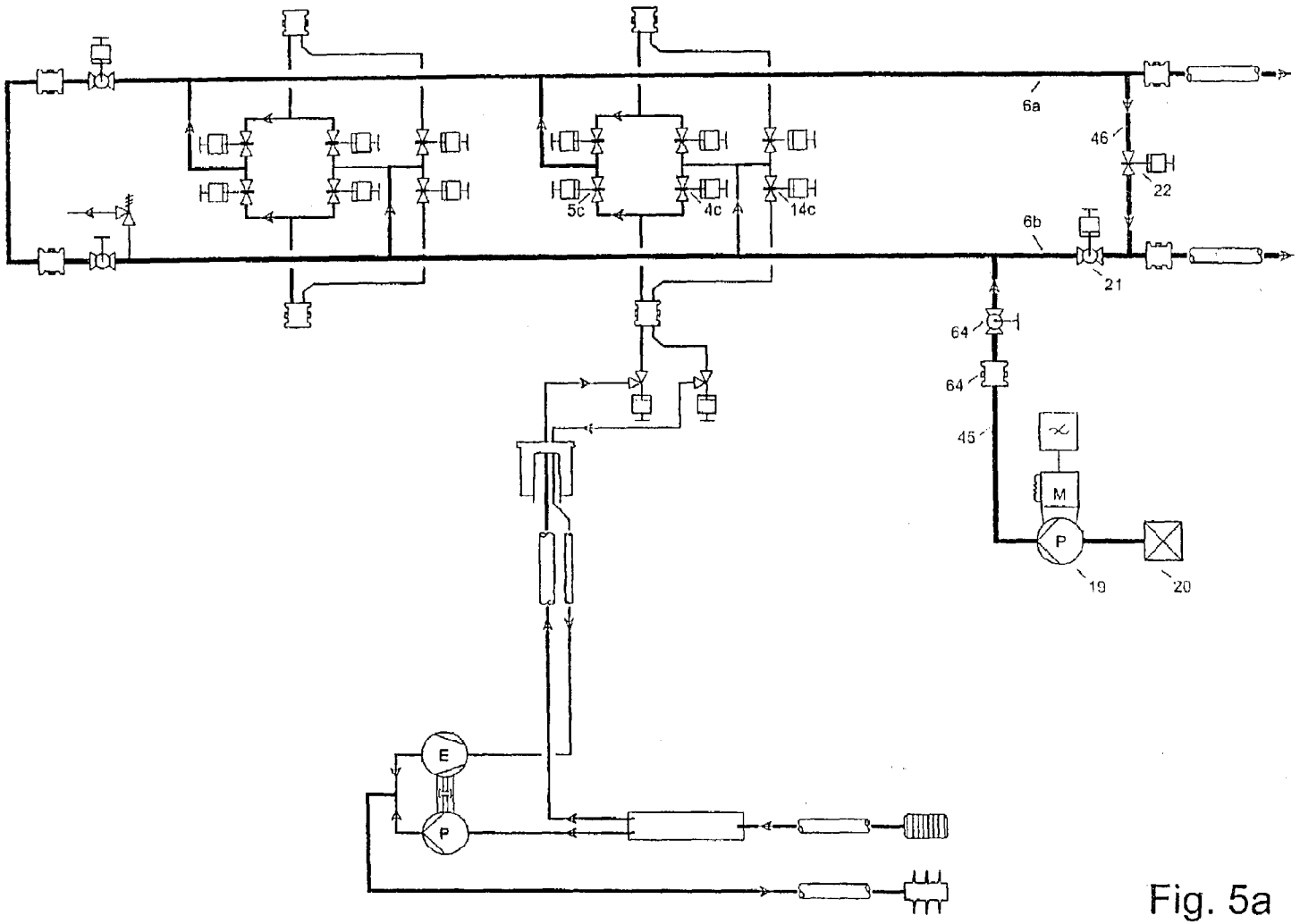
FIG. 5*a* shows a layout of a production manifold and well according to an eighth embodiment of the present invention, showing power water supplied from surrounding seawaters pressurized by a subsea pump with discharge commingled with formation water and injected.

FIG. 5*a* is a further embodiment and illustrates the application of a subsea located speed controlled pump 19 connected to the second header 6*b* within the manifold 41 supplying power fluid as seawater taken from the surrounding sea via a pipeline 45, connector 64 and shutoff valve 65. Solids and particles are removed by use of a filtration device 20 on the pump suction side. An isolation valve 21 is placed in the second header 6*b* and when closed prevent power fluid from entering the connected flowline 8*b*. A crossover pipe spool 46 with an isolation valve 22 connects the two headers 6*a*, 6*b*. With this valve in open position produced hydrocarbons can be routed from the first header 6*a* into both flowlines 8*a*, 8*b*.

Also here conventional production according to FIG. 1*a* may be achieved by closing the isolation valves 14*a*, 14*b*, 14*c*, 14*d* and opening the isolating valves 4*a*, 4*b*, 4*c*, 4*d*. The isolation valve 67 will be closed to avoid production fluid entering the pump 19.

Figure 5B:
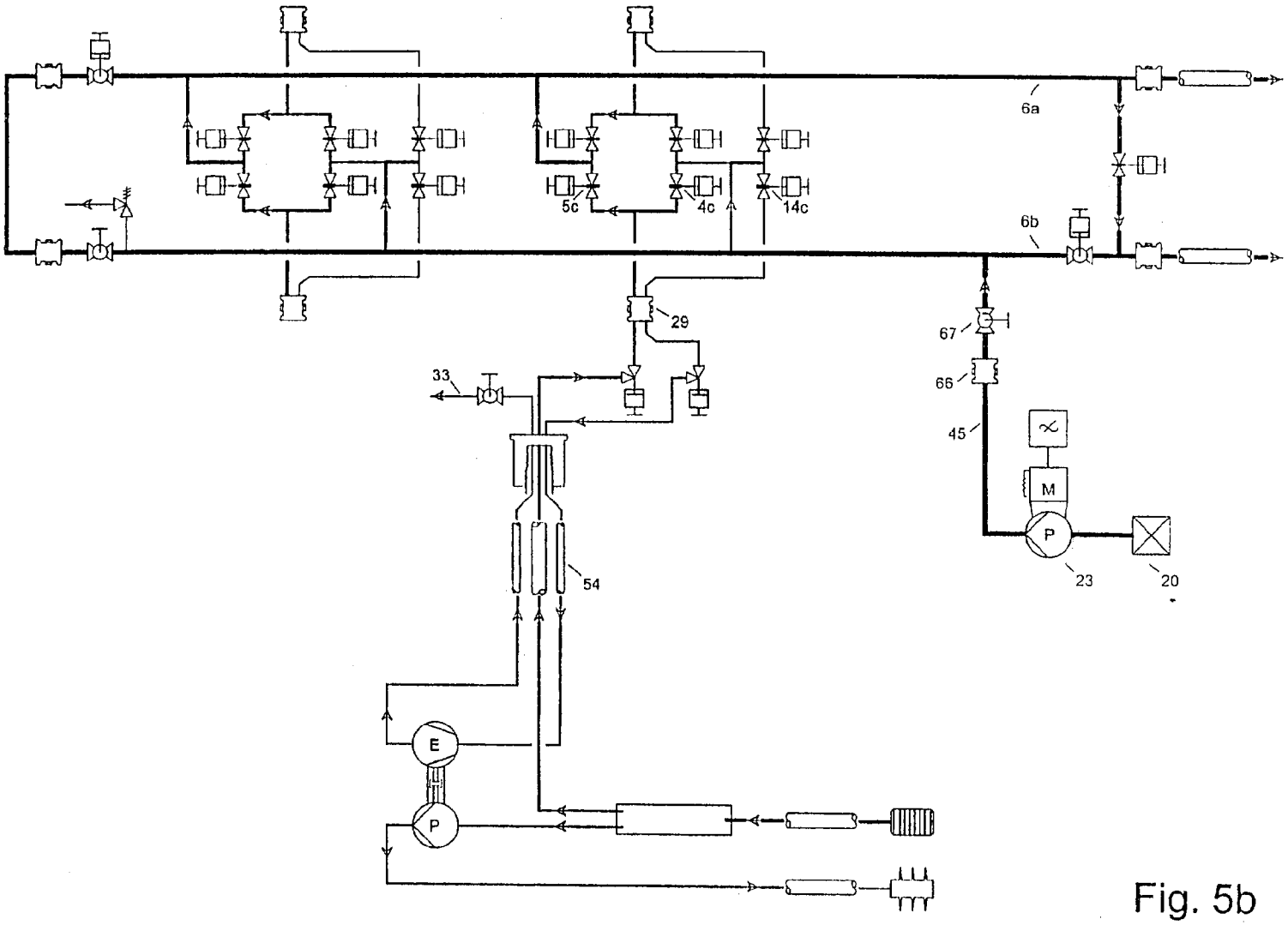
FIG. 5*b* shows a layout of a production manifold and well according to a ninth embodiment of the present invention showing a diversion of the embodiment of FIG. 5*a*, with discharge water being released to the surrounding seawaters.

FIG. 5*b* illustrates the use of an open loop with seawater used as power fluid, and is a derivation of the embodiment shown in FIG. 5*a*. Filtrated seawater, filtered by the filter 20, drawn from the surrounding seawaters, is pressurized by a speed controlled electrical charge pump 23 and delivered to the second header 6*b* via a connector 66 and shutoff valve 67. From the second header 6*b* the power fluid is fed through the choke valve 2 down to the downhole turbine 16 and instead of commingling the water with injection water, it is returned through the return line 54, at the end 33 of which the water is discharged to the surroundings.

Also here conventional production according to FIG. 1*a* may be achieved by closing the isolation valves 14*a*, 14*b*, 14*c*. 14*d* and opening the isolating valves 4*a*, 4*b*, 4*c*, 4*d*.

The isolation valve 67 will be closed to avoid production fluid entering the pump 23. Return line 54 may also be provided with an isolation valve or check valve (not shown) to avoid seawater entering line 54.

Figure 6:
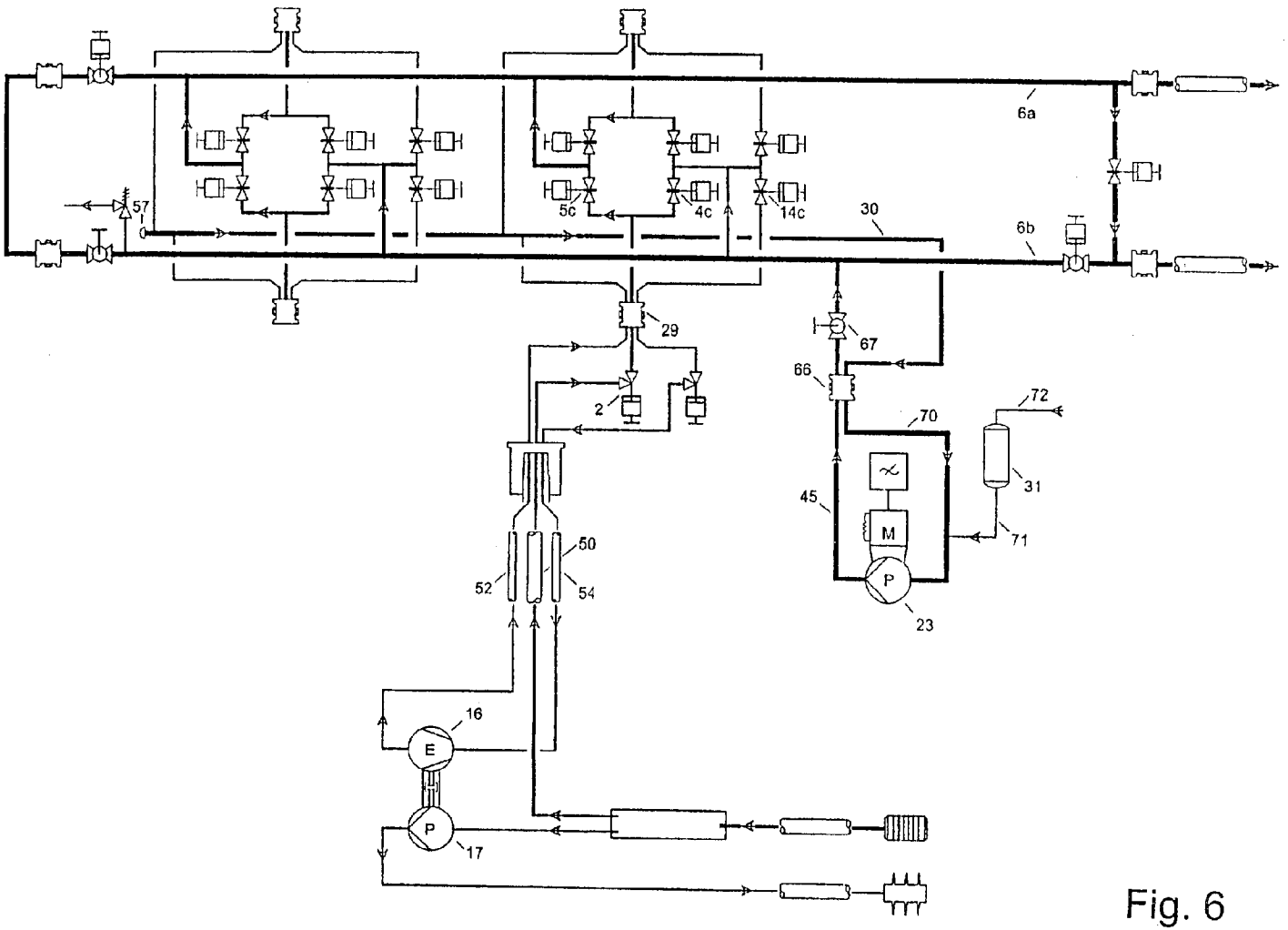
FIG. 6 shows a layout of a production manifold and well according to a tenth embodiment of the present invention, showing a closed circuit driven hydraulic powered pump in the hydrocarbon producing well.

FIG. 6 illustrates a concept with a closed loop of power fluid. Here each well is equipped with an additional flowline 54 for return power fluid. A mechanical connector 29 connects the line 54 with a third header 30. The third header communicates with a charge pump 23, via a connector 66 and a line 70.

The power fluid from the pump 23 is routed via the connector 66, a shutoff valve 67 and the second header 6*b* through the choke valve 2, the production x-mas tree 1 on the injection side of the tree and is transported to the downhole turbine 16 in a separate tubing 52 or in an annulus formed by casing, production and power fluid tubing. The power fluid returns after the turbine expansion process in the return line 54 to the subsea wellhead, which is either a separate tube or the annulus if this was not used for feed of power fluid. From the return line the power fluid is delivered via the mechanical connector 29 to the third header 30 in the manifold.

An accumulator tank 31 is connected to the line 70 leading from the connector 66 to the charge pump 23 inlet side, via a separate line 71. The accumulator 31 may also be in communication with a fluid source, e.g. surrounding seawater, through a line 72, to replace power fluids lost due to leakage or for other reasons.

The power fluid return from all wells is routed via the third header 30, from where it is supplied to the charge pump 23, pressure boosted and delivered to the second header 6*b*. The third header 30 may be provided with an intake at 57, provided with a check valve (not shown), as an alternative to the power fluid supply through line 72.

Also here conventional production according to the functioning of the FIG. 1*a* layout may be achieved by closing the isolation valves 14*a*, 14*b*, 14*c*, 14*d* and opening the isolating valves 4*a*, 4*b*, 4*c*, 4*d*. The isolation valve 67 will be closed to avoid production fluid entering the pump 23.

Figure 7:
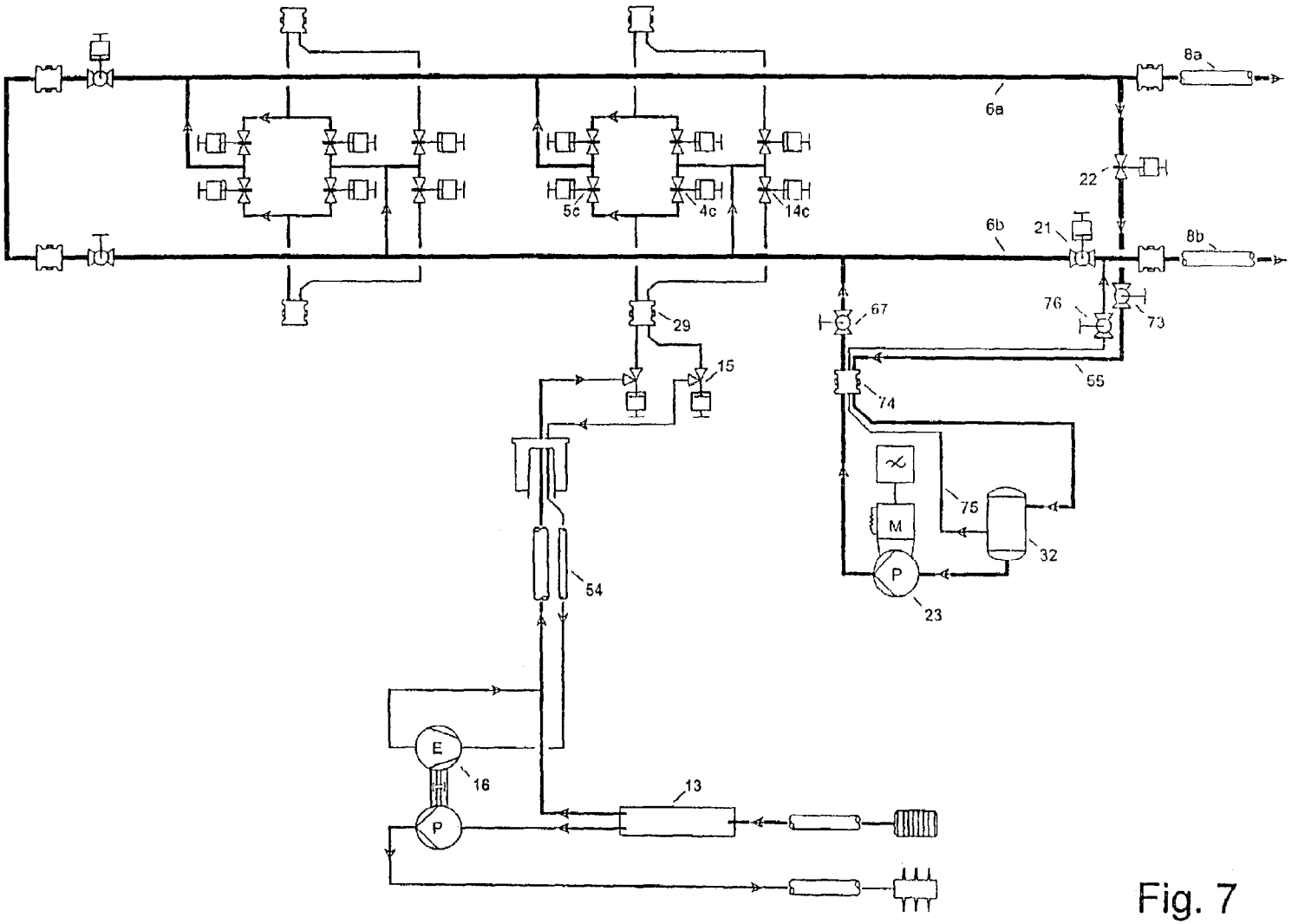
FIG. 7 shows a layout of a production manifold and well according to an eleventh embodiment of the present invention, showing the use of produced hydrocarbons as power fluid.

FIG. 7 illustrates the use of produced oil as power fluid for a downhole hydraulic subsurface pumping system (HSP). The first header 6*a* is via a line 55, a shutoff valve 73 and a connector 74, communicating with a gas-liquid separator 39, which in turn is communicating with the charge pump 23. The charge pump 23 is communicating with the second header 6*b*, via the connector 74 and a shutoff valve 67, which in turn is communicating with the downhole turbine expander 16 via isolating valve 14*c*, mechanical connector 43, choke valve 15 and x-mas tree 1. The outlet side of the turbine 16 is communicating with the production flowline 40.

In line 55 an isolation valve 22 is also mounted.

The gas-liquid separator 32 is also connected to a gas line 75, which is via the connector 74 and a shutoff valve 76, connected to the second header 6*b* at the flowline side of a shutoff valve 21

The isolation valve 22 is set in open position allowing some of the produced hydrocarbons to be routed to the gas-liquid separator 32. In the gas-liquid separator 32, the gas is separated and transported to the second header through line 75. The shutoff valve 21 is closed and the gas is therefor transported through the flow line 8*b*. A suitable rate of the separated oil is supplied to the charge pump 23 and delivered pressurized to the second header 6*b*. The isolation valve 4*c* is closed and the isolation valve 14*c* is open. The power fluid is thereby routed into the injection side of the dual function x-mas trees via the injection choke valve 15. When leaving the downhole turbine 16, the power fluid is commingled with the produced hydrocarbons from the downhole separator 13 and brought to the wellhead (x-mas tree 1). From all producing wells the hydrocarbons are routed to the first header 6*a* via the open isolation valve 5*c* and finally into the first flowline 8*a* to be transported to an offshore installation or onshore.

Also here conventional production according to FIG. 1*a* may be achieved by closing the isolation valves 14*a*, 14*b*, 14*c*, 14*d* and opening the isolating valves 4*a*, 4*b*, 4*c*, 4*d*. An isolation valve (not shown) may also be provided in line 45 to avoid production fluid entering the pump 23. Isolation valve 22 will preferably be in a closed position, shutoff valve 67 will be closed to avoid production fluids entering the pump 23, and shutoff valve 76 will also be closed to avoid production fluids entering the gas-liquid separator 32.

Figure 8:
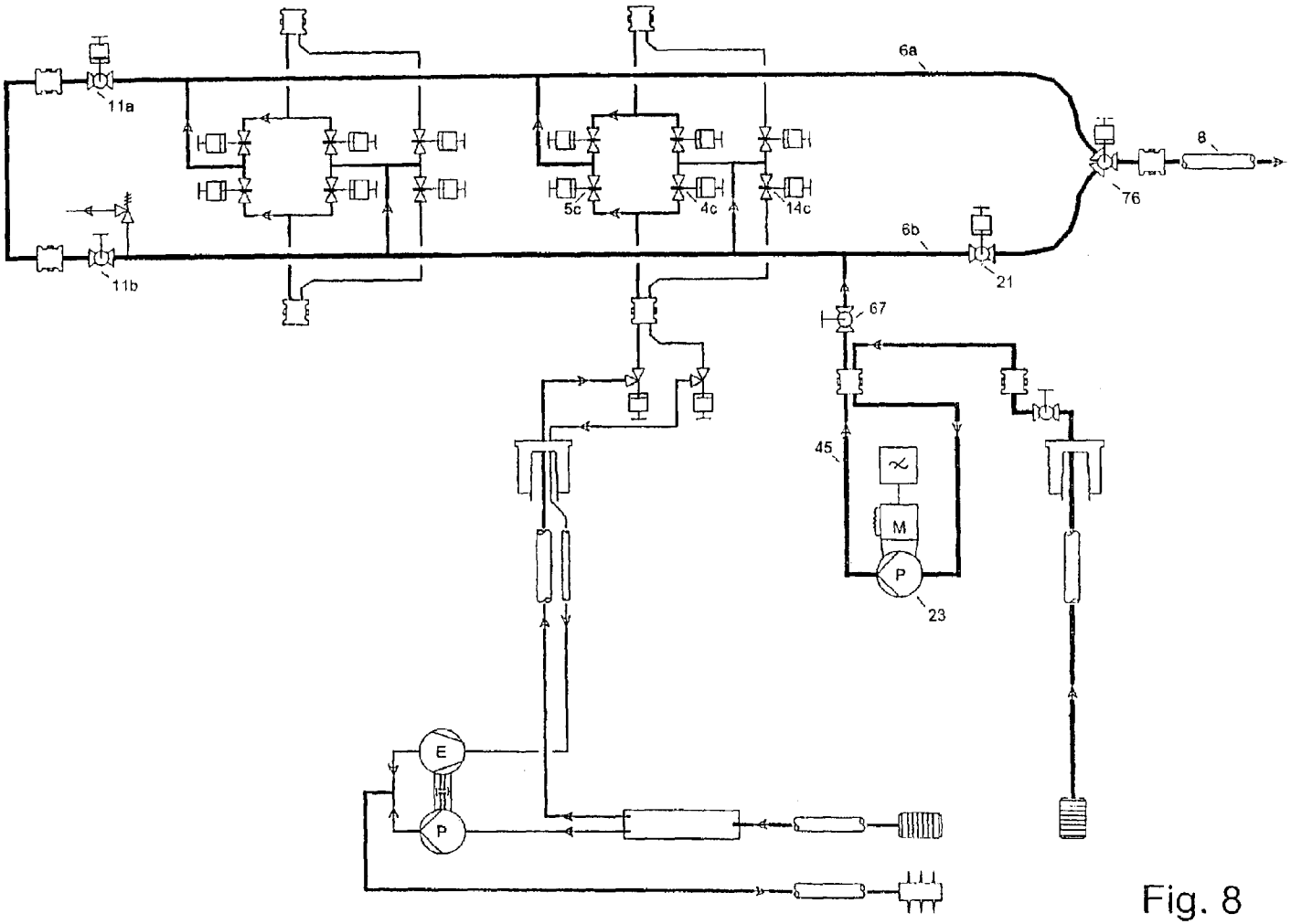
FIG. 8 shows a layout of a production manifold and well according to a twelfth embodiment of the present invention, comprising the use of only one flowline.

FIG. 8 illustrates the use of a single flowline 8 instead of the two flowlines 8*a* and 8*b*. The flowline 8 is connected to the two headers 6*a* and 6*b* via a three way valve 76. The three way valve is designed to open communication between either of the two headers 6*a* and 6*b* and the flowline 8. In the second header 6*b* a shutoff valve 21 is provided.

In the shown embodiment, power fluid is supplied from a subterranean water producing well, in the same way as shown in the embodiment of FIG. 4*d*, however, the downhole pump 28 being omitted. The power fluid is also supplied to the turbine 16 and discharged to the injection line 42 as described in FIG. 4*d*. However, it should be understood that any of the other described embodiments in which power fluid can be supplied form a nearby source, can be used together with the single flowline concept.

During normal production together with water injection the three way valve will provide for communication of production fluids from the first header to the flowline 8, and isolating the second header 6*b* form the flowline 8 and the first header 6*a*. The second header being used for supply of power fluid.

The above explained arrangement allows for the use of only one flowline between the seabed and the platform or facilities onshore. This will enable substantial cost savings.

The main reason for using two flowlines has been the possibility to make so called round pigging. This is an alternative to have a pig launcher at one end of the flow line and a pig receiver at the other end of the flowline. The round pigging procedure is a much simpler and inexpensive way of making the necessary pigging.

Even though the embodiment of FIG. 8 has only one flowline, it is still possible to perform round pigging. To perform this, first the production is stopped. The charge pump 23 is used to purge the flowline 8 with valve 21 open and valves 1 la and 11*b* closed and with the producing wells shut off. The pump 23 is then shut off, the shutoff valve 67 closed, the three way valve set in a position to enable communication between the flowline 8 and the second header and a pig (not shown) is then launched from the platform or from the onshore facility. Displaced water may be evacuated to the surroundings, into the hydrocarbon producing wells, or to a disposal tank (not shown). The position of the pig within the manifold is detected. When the pig is driven past the water injection branch 45, it is stopped. The valves 11*a* and 11*b* are opened, the valve 21 is closed and the valve 76 is opened to enable communication between the first header 6*a* and the flowline 8. The charge water pump 23 is started, driving the pig through the spool 9, into the first header 6*a* past the valve 11*a*. The valve 11*a* is then closed and the wells are then opened for production into the first header 6*a*. The production fluids are pushing the pig back through the valve 76 and the flowline 8 to the host. Normal production is resumed.

The flowline 8 may be a single integrated flowline, power cable and service umbilical connected to the subsea production system utilizing, downhole separation and water injection.

Figure 9A:
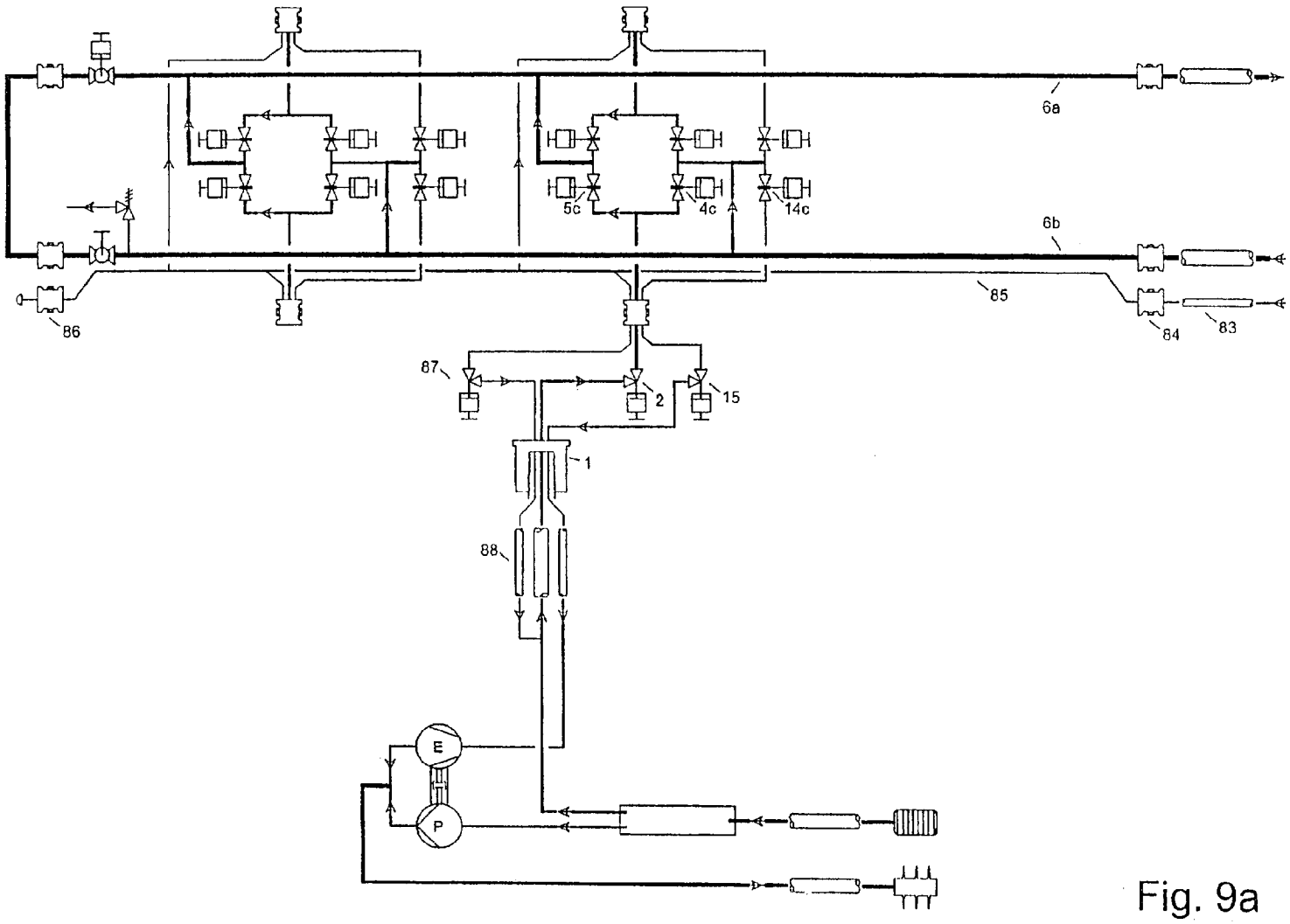
FIG. 9*a* shows a conventional gas lift arrangement used in an arrangement according to the invention of the type shown in FIG. 2*a*.

FIG. 9*a* shows a conventional method for achieving gas lift in a hydrocarbon producing well. The gas is supplied from a distant location through a separate pipe 83. which may be a part of an umbilical. The pipe 83 is connected to a third header 85 via a connector 84. The third header 85 is at the opposite end connected to a further connector 86, and may be connected through this with further manifolds.

Via connector 3*c* the third header 85 is connected with a choke valve 87 and further, via x-mas tree 1, with a gas line 88, which in turn is connected to the production tubing 40, to transport gas into the production tubing 40.

The parts of FIG. 9*a* not specifically described are identical with FIG. 2*a*.

Figure 9B:
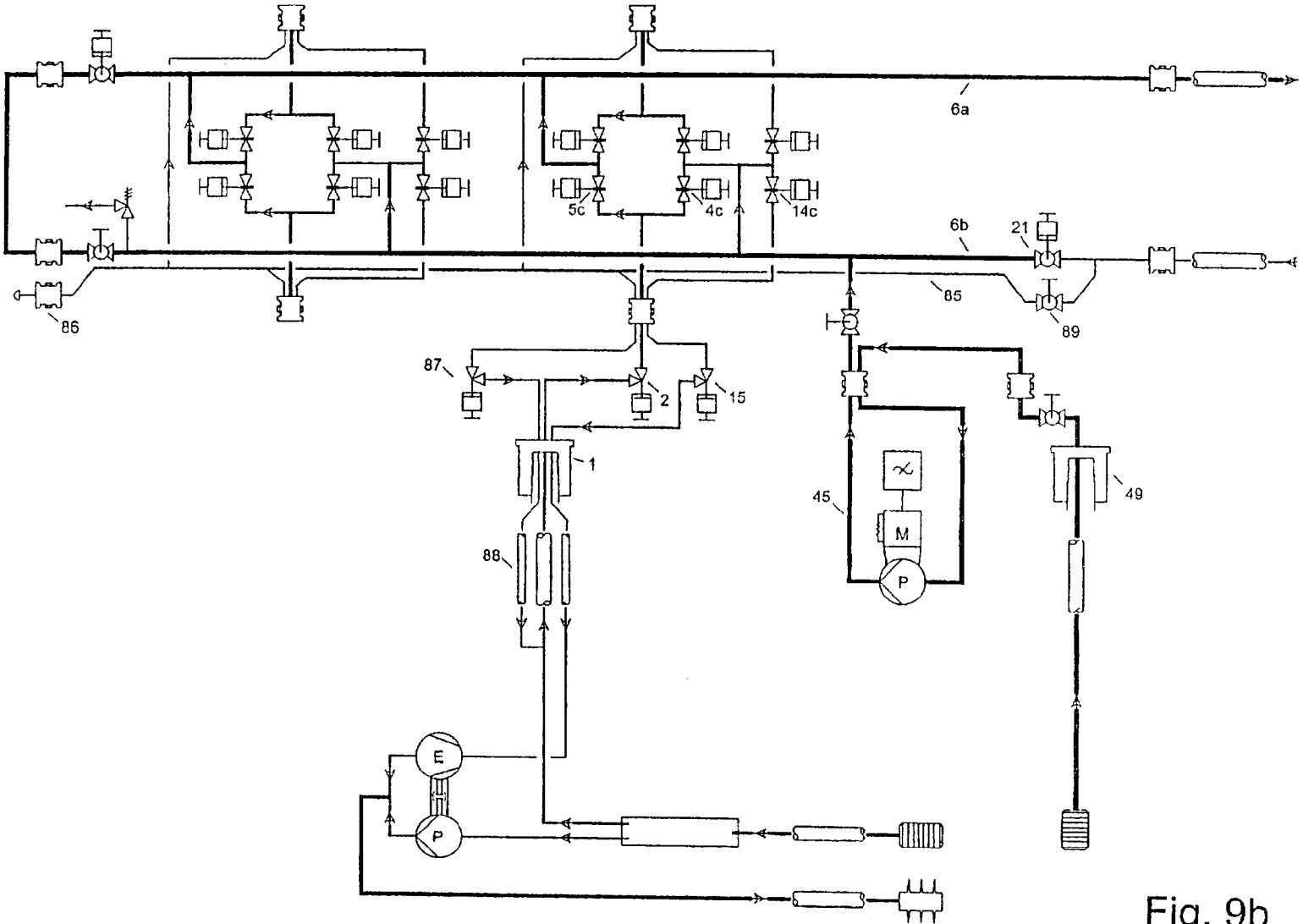
FIG. 9*b* shows a layout of an arrangement for providing gas lift according to an embodiment of the present invention, with gas supply in one of the flowlines.

FIG. 9*b* illustrates a gas supply arrangement for gas lift according to an embodiment of the present invention. Gas is supplied from a distant location through a gas pipe 83. The gas is branched off before the closed shut off valve 21 and lead through a shut off valve 89 to a third header 85, and further through connector 3*c*, choke valve 87 and gas line 88 to production tubing 40.

Supply of power fluid to the downhole turbine 16 is transported through the second header 6*b* on the other side of the closed shut off valve 21 from the gas supply. In all other respects the layout is identical with FIG. 2*a*.

Opposite to the arrangement of FIG. 9*a* it is, with the arrangement of FIG. 9*b*, possible to perform gas lift with only two flowlines 8*a* and 8*b* connected to the manifold.

Figure 9C:
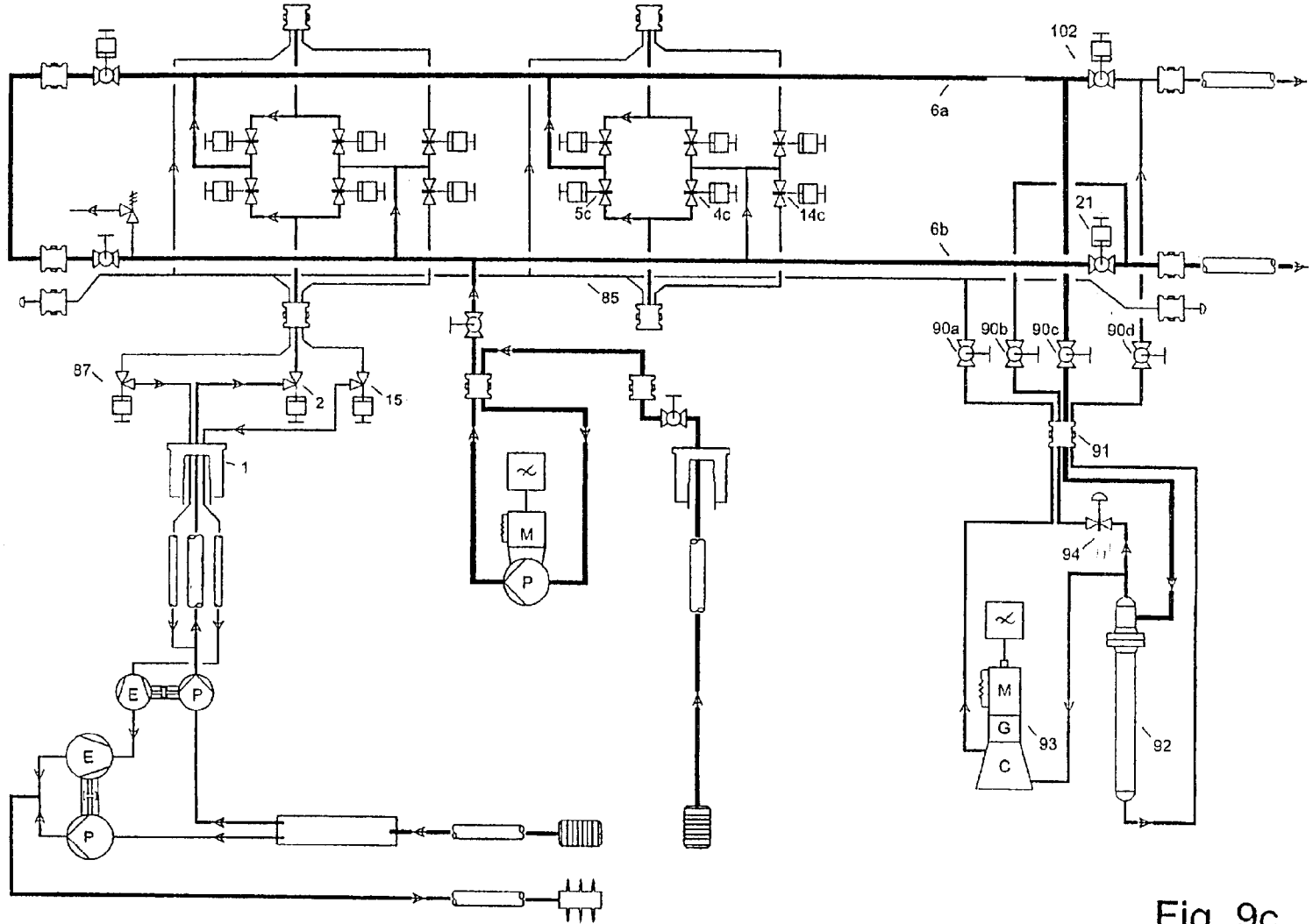
FIG. 9*c* shows a layout of an arrangement according to the invention for providing gas for artificial lift locally.

FIG. 9*c* illustrates the use of a local gas lift re-cycling loop at the production area. The concept is illustrated in conjunction with water injection, but is relevant also with conventional production. Well fluid is routed from the first header 6*a*, with isolation valve 102 closed, through a shut off valve 90*c* and a connector 91 to a gas-liquid separator 92. The liquid phase is returned through the connector 91 and a shut off valve 90*d* to the first header at the downstream side of the valve 102 and flow by pressure to the host via the first flowline 8*a*. A suitable rate of gas extracted from the separator 92 is pressurized by a speed controlled compressor 93 and delivered through the connector 91 and a shut off valve 90*a* to a third header 85. The rest of the gas is lead though an isolation valve 94, the connector 91 and a shut off valve 90*b* to the second flowline 8*b* at the downstream side of the closed valve 21 and transported to the host. The gas in the third header 85 is from here distributed to the individual wells by use of a choke valve 87 situated on x-mas tree or on the manifold. The concept may also include re-cycling loops on the compressor or within the manifold.

Figure 10A:
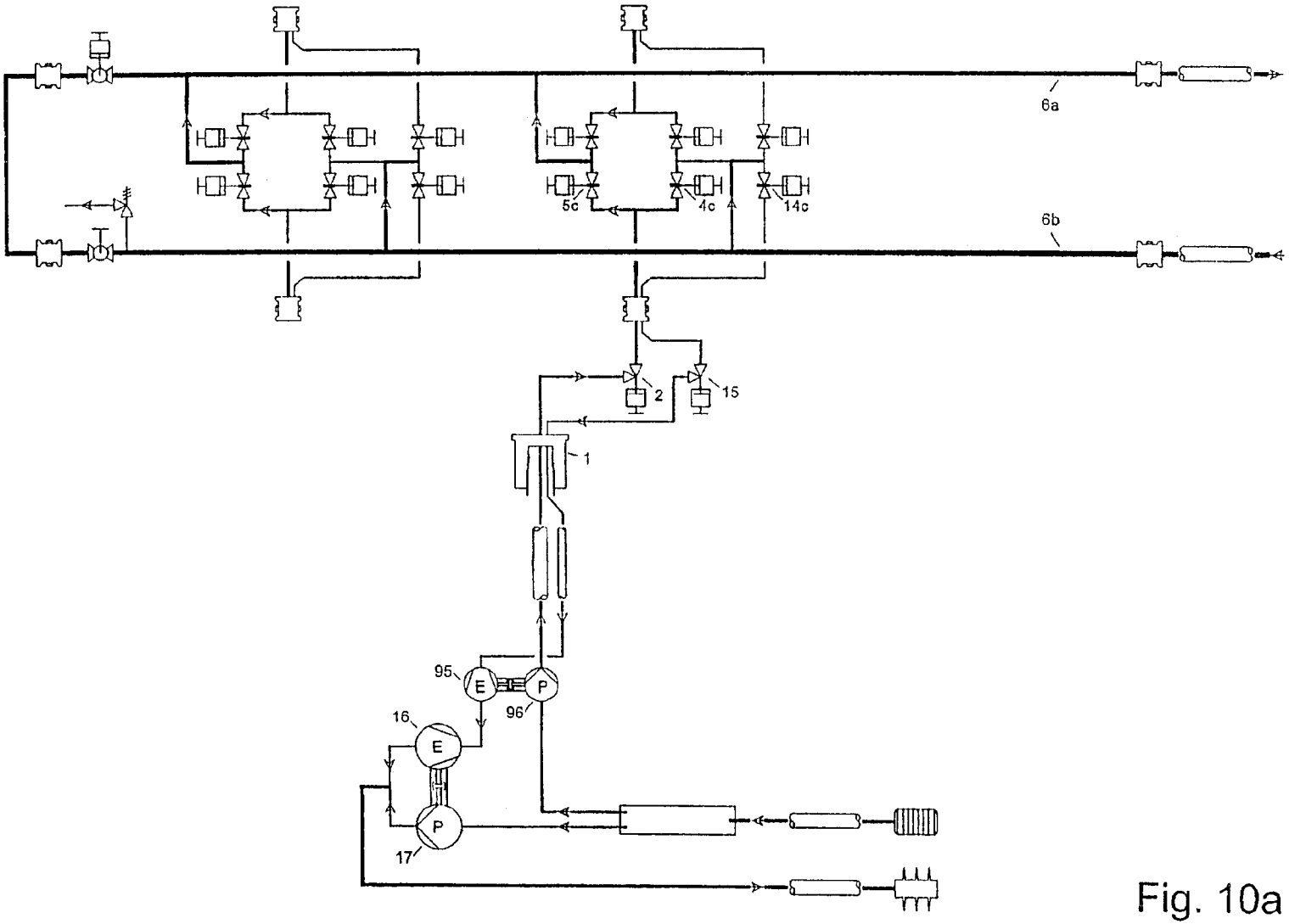
FIG. 10*a* shows a layout of an arrangement according to the present invention comprising a downhole hydraulic turbine/pump converter for boosting the pressure of the well fluid coupled in series with the turbine/pump converter for pumping separated water.

FIG. 10*a* shows power fluid supplied through the second header 6*a*, though the connector 3*c*, choke valve 15 and x-mas tree 1 to a turbine 95. Turbine 95 drives, through a shaft, a pump 96 for pumping production fluid to provide artificial lift.

From the turbine 95 the power fluid is lead to the turbine 16, driving the pump 17 pumping the separated water. After leaving the turbine 16 the power water is commingled with the separated water and injected in an injection formation 81.

Power fluid may alternatively be supplied first to the turbine 17 and then routed to the turbine 95. When two turbines are coupled in series, the turbine used for boosting production fluid will be design to give a suitable pressure increase whilst the one injecting water is operated with respect to maintaining separator performance, the control of the latter taking precedence over the former.

Figure 10B:
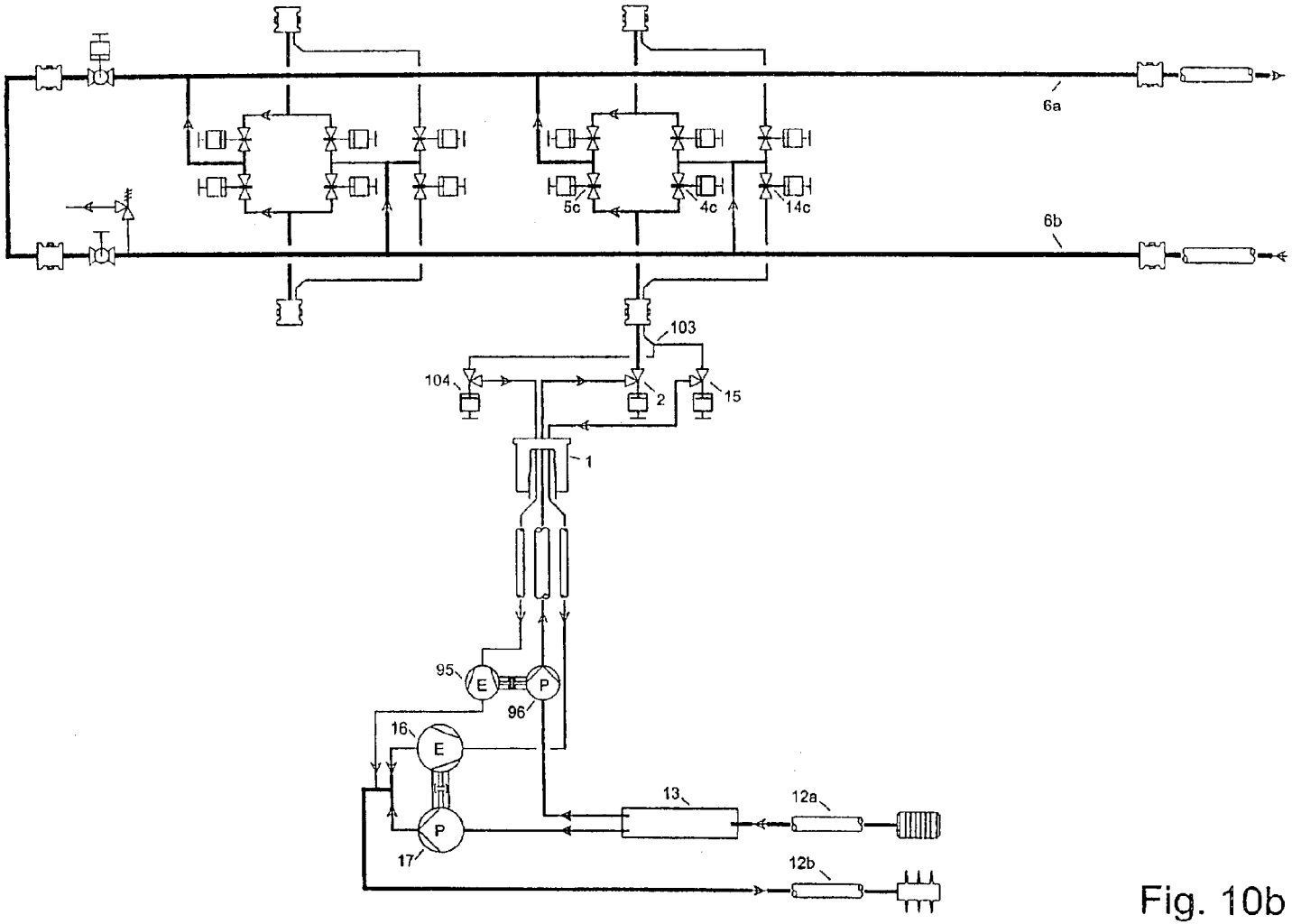
FIG. 10*b* shows a similar layout to FIG. 10*a*, but with a parallel configuration with dedicated wellhead chokes for the turbine/pump converter for the well fluid and the turbine/pump converter for separated water.

FIG. 10*b* shows a diversion of the embodiment of FIG. 10*a*. The power water from the second header 6*b* is split at 103. A first part of the water is lead down through choke valve 15 and x-mas tree 1 to turbine 16, driving pump 17 pumping separated water. A second part of the power water is lead through a second choke valve 104 and the x-mas tree 1 to the turbine 95, driving the pump 96 pumping production fluid. The water from the turbine 16 and theiturbine 95 is commingled with the separated water and injected into formation 81. As an alternative, the water from the outlet side of one of the turbines may be routed into the inlet side of the other.

Figure 10C:
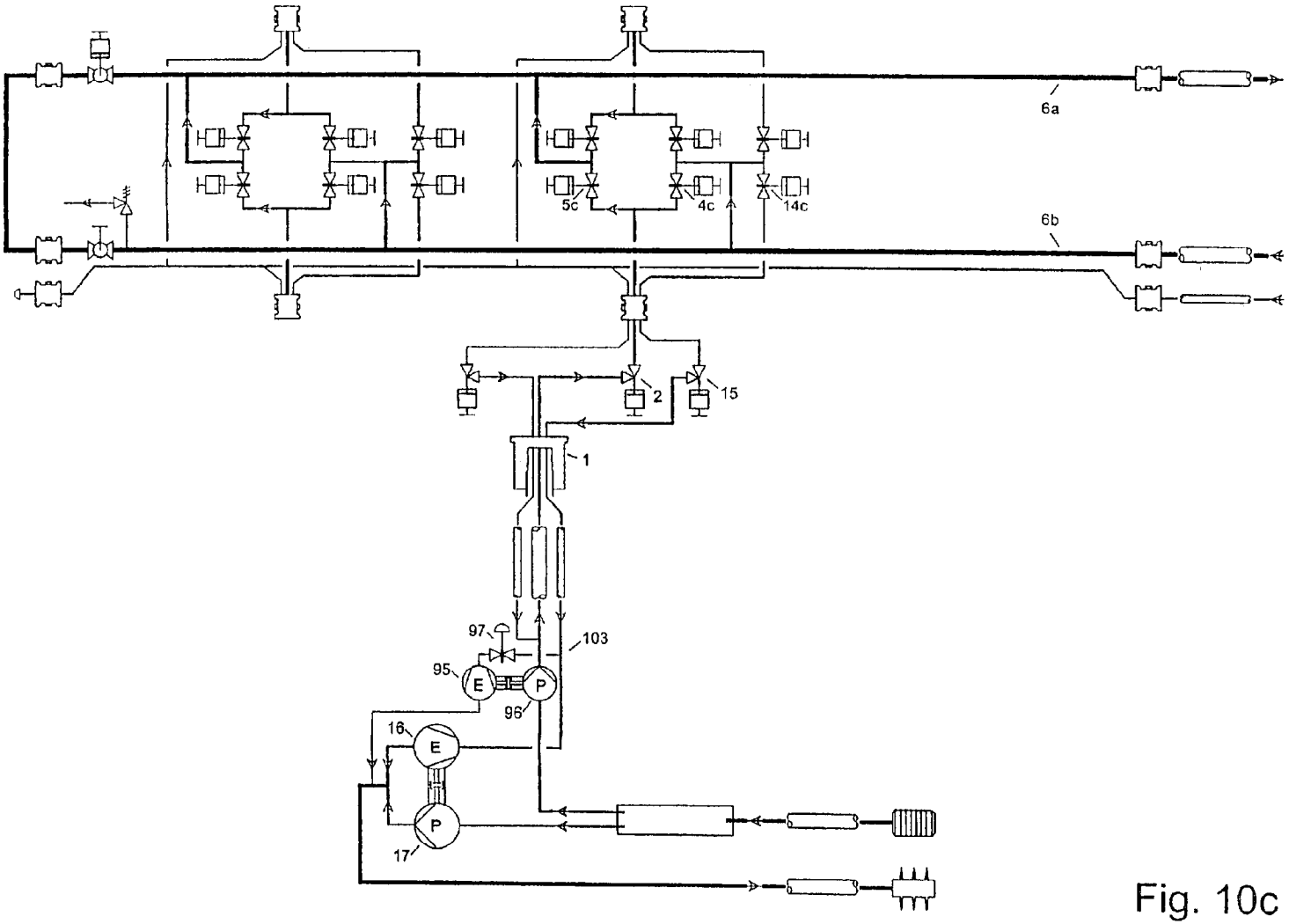
FIG. 10*c* shows a similar layout to FIG. 10*b*, but with parallel configuration of the turbine/pump converter for the well fluid and the turbine/pump converter for separated water with a downhole control valve for the turbine/pump converter for the well fluid.

FIG. 10*c* shows an embodiment of the invention with both gas lift and pumping of production fluid. Gas lift is provided as shown in FIG. 9*a*, but could just as well be provided by the means shown in FIG. 9*b* or 9*c*.

The power water is lead though the choke valve 15 and the x-mas tree 1. At 105 the water is split. A first part of the water is lead down to the turbine 16, driving the pump pumping separated water. The second part of the power water is lead through a control valve 97 and to the turbine 95, driving the pump 96 pumping production fluid. The water from turbines 16 and 95 is commingled with the separated water and injected in formation 81. Instead of control valve 97 a fixed orifice may also be used.

Suitable flow-split at 105 can also be accomplish by design of turbine vanes. stages, inlet piping and restriction orifices. The shown downhole hydraulically or electrically operated control valve 97 can together with the choke valve 15 control the ratio and amount of power fluid supplied to the two turbines and thereby facilitating control of the boosting of production fluid independent of the control of the injection of water. Gas lift may also be used for artificial lift in combination with pressure boosting the oil to seabed as explained below.

Figure 11A:
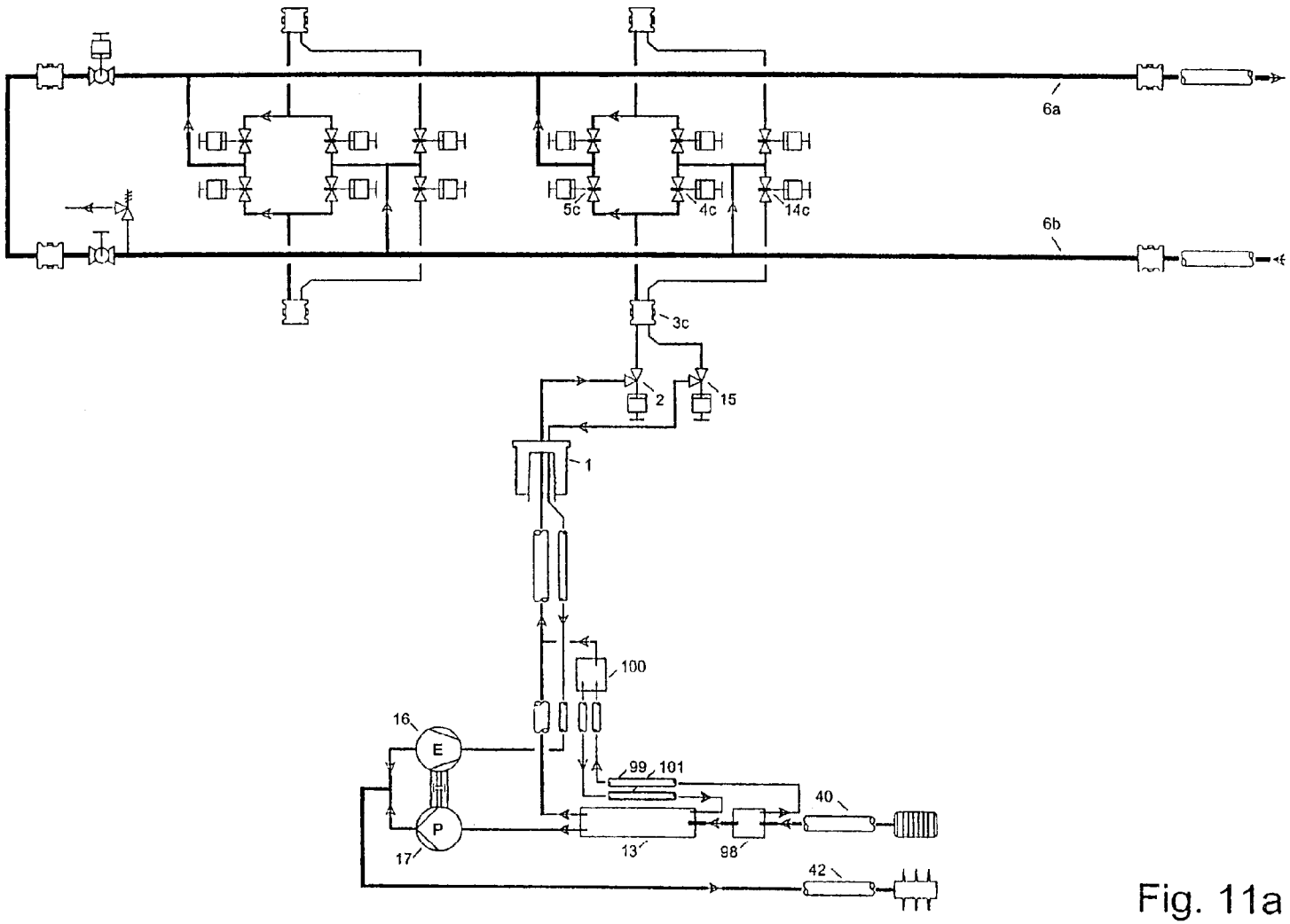
FIG. 11*a* shows a layout of a downhole arrangement for gas-liquid separation upstream of a liquid-liquid separation and with a gas scrubber.

FIG. 11*a* illustrates the use of a multiphase (gas-oil-water) downhole separation system. Well fluid enters a gas-liquid separator 98 where the gas phase is extracted and routed through line 99 past the oil-water separator 13 in a pipe to a downstream gas-liquid scrubber 100. Liquid entrained in the gas flow is separated using high g-force and routed back to the separator 13 though line 101. The scrubber 100 is placed at suitable elevated level allowing the liquid to be drained by gravity through the line 101 into the oil-water separator 13. The clean gas is injected into the oil phase in production line 40 for flow to the wellhead 1. Optimal performance requires a well pressure balanced system. When water entrainment in oil is not a critical issue the scrubber stage with the drainage pipe may be omitted.

Figure 11B:
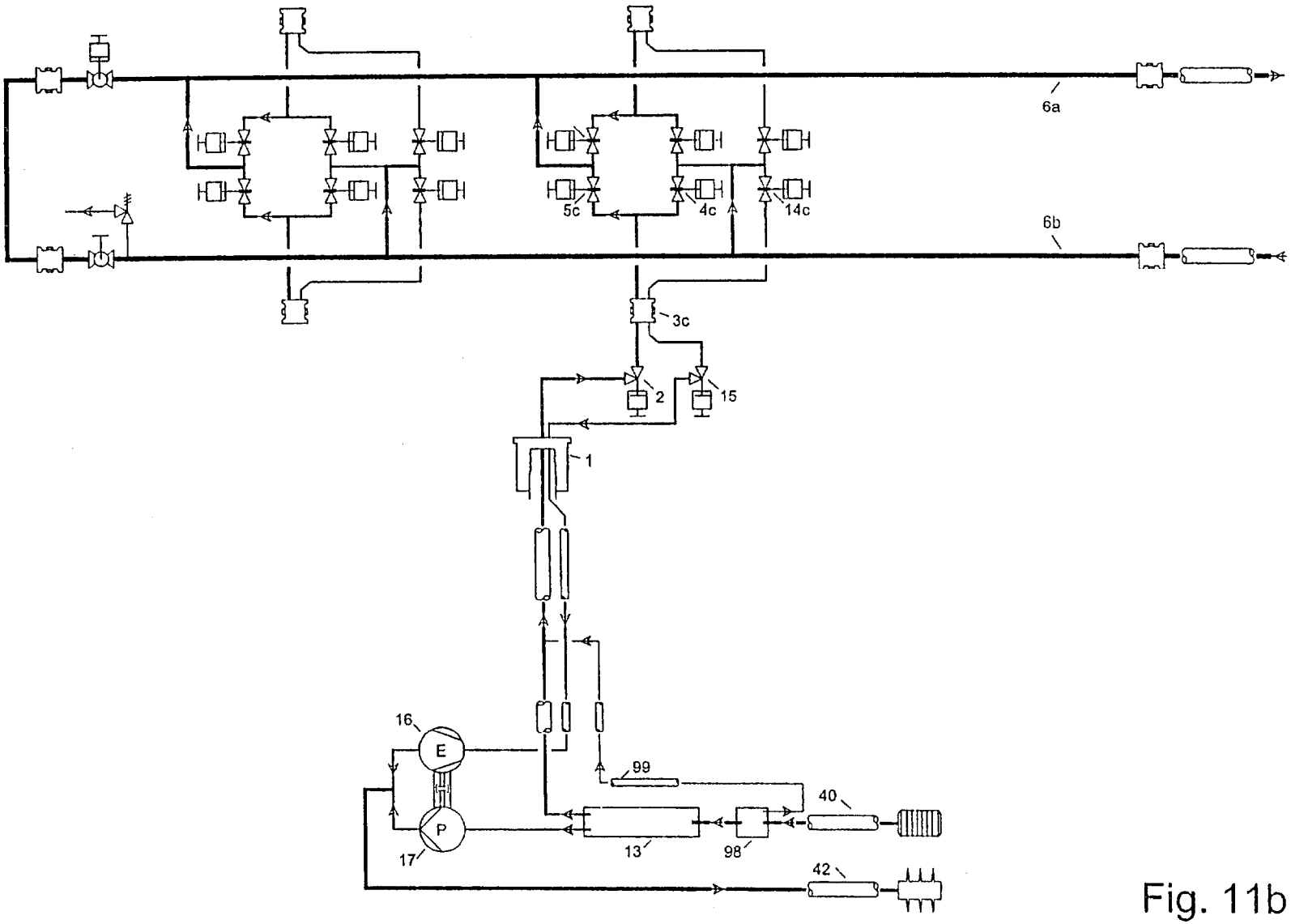
FIG. 11*b* shows a similar layout to FIG. 11*a*, but without a scrubber.

FIG. 11*b* shows a two stage mutltiphase (gas-water-oil) downhole separation without a gas scrubber. The production fluid is lead into a gas-liquid separator 98, in which the gas is separated from the liquid. The gas is lead through a pipe 99 and into the production line 40, where it is used for gas lift. The liquid is lead into a oil-water separator 13, where oil is separated to the production line 40 and water is separated to be pressurised by pump 17 and injected together with power water from turbine 16.

A downhole turbine/pump hydraulic converter may be used also in connection with the embodiments of FIGS. 11*a* and 11*b*. The pump may be placed before the gas-liquid separator 98, between the gas-liquid separator 98 and the liquid-liquid separator 13 or after the liquid-liquid separator 13.

Figure 11C:
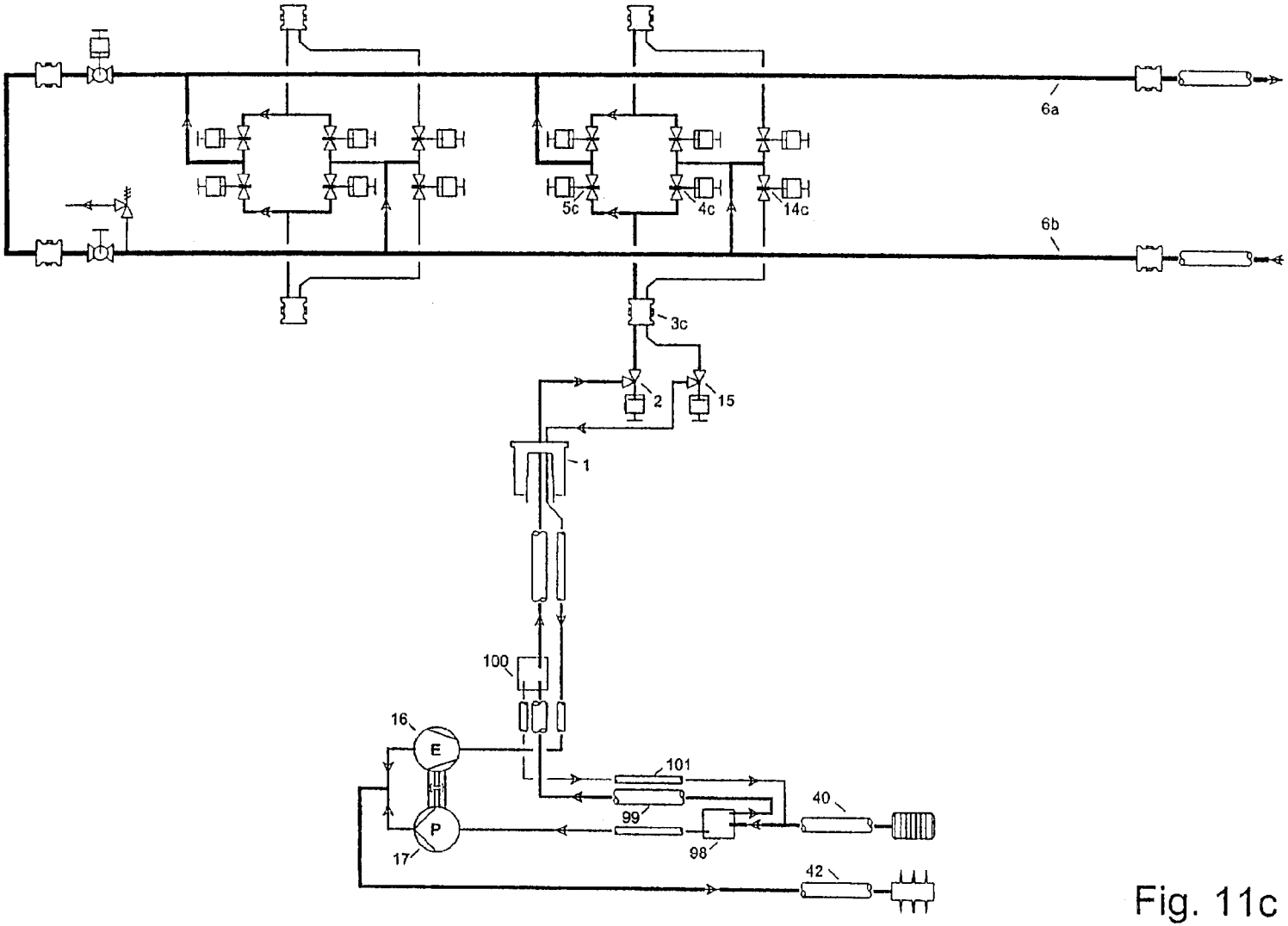
FIG. 11*c* shows a gas-liquid separation only with a gas scrubber.

FIG. 11*c* illustrates the use of a two stage downhole gas-liquid separation system. Well fluid enters a gas-liquid separator 98 where the gas phase is extracted and routed in a pipe 99 to a gas-liquid scrubber 100. Liquid entrained in the gas flow is separated using high g-force. The scrubber 100 is placed at suitable elevated level allowing the liquid to be drained by gravity through a pipe 101 to upstream of the gas-liquid separator 98, and may consist of one or more separation stages. Dry gas exit the scrubber 100 and flows to the wellhead 1 either in production tubing 40 or in an annulus formed by the casing and the production tubing.

Water is taken from the separator 98, pressurized by pump 17 and injected together with power fluid exiting turbine 16.

Optimal performance requires a well pressure balanced system. The separation system is also applicable when condensate is to be re-injected back into the formation. This embodiment is preferable for wells which mainly produce gas with little oil.

The separators may be of one of the types described in Norwegian patent application No. 2000 0816 by the same applicant.

For all illustrated embodiments of the present invention an additional line (not shown) and an additional isolation valve (not shown) may be provided to make it possible to route the production through the second header and the power fluid and/or injection fluid through the first header.

Instead of injecting the water into the formation, the water may also be transported LIP to the surface in the return line 54 or a separate line (not shown) for subsequent processing and/or disposal.

All the described production alternatives can be enhanced as required to include subsea processing equipment for gas-liquid separation, further hydrocarbon-water separation by use of electrostatic coalesces, single phase liquid pumping, single phase gas compression and multiphase pumping. In case of subsea gas-liquid separation, gas may be routed to one flowline whilst the liquid is routed to the other.

Any connector may be of horizontal or vertical type. Return and supply lines may be routed through a common multibore connector or be distributed using independent connectors.

Choke valves may be located on the x-mas tree as shown in attached figures, but can also be located on the manifold. The valves may if required be independent retrievable items. Choke valves subsea are normally hydraulic operated but may be electrical operated for application where a quick response is needed.

Electrically operated pumps are not illustrated in attached figures with utility systems for re-cycling, pressure compensation and refill. One pump only is show for each functional requirement. However, depended on flowrates, pressure increase or power arrangement with several pumps connected in parallel or series may be appropriate.

The present invention also provides for any working combination of the embodiments shown herein. The invention is limited only by the enclosed independent claims.

The invention claimed is:

1. A method of controlling a downhole separator, for separating hydrocarbons and water, the hydrocarbons leaving the separator flowing through a x-mas tree and a first header in a manifold, the method comprising:

using a power fluid to drive a downhole turbine/pump hydraulic converter, operating the pump in the downhole turbine/pump hydraulic converter to pump separated water, feeding the power fluid for the downhole turbine/pump hydraulic converter through a second header in the manifold, an adjustable valve and a x-mas tree to the turbine in the downhole turbine/pump hydraulic converter, and controlling the rate of pumping by the rate of the power fluid based on at least one of measures of water level in the separator, flow-split and at least one of oil and water entrainment of the separated phases.

2. The method of claim 1, characterized in that the rate of pumping of separated water is controlled by a charge pump in communication with the second header.

3. A method of supplying power fluid to a turbine/pump hydraulic converter, the method comprising the steps of:

providing a manifold having a first and a second header, providing communication between the first header and a well fluid line in the well bore, providing communication between the second header and the turbine of the downhole turbine/pump hydraulic converter wherein the turbine/pump hydraulic converter is positioned in a downhole location, and supplying power fluid to the turbine through the second header at a pressure higher than a well pressure.

4. The method of claim 3, characterized in that water from the pump in the downhole turbine/pump hydraulic converter is used for injection in a formation.

5. The method of claim 3, wherein surrounding seawater is used as power fluid and is either injected into a reservoir together with separated produced water or returned to the seabed and discharged to the surrounding sea.

6. The method of claim 3, wherein the power fluid is extracted from a formation and is free flowing from an aquifer to the seabed or pumped to the seabed using a downhole electrical operated pump or a second downhole turbine/pump hydraulic converter.

7. The method of claim 3, wherein the power fluid is circulated in a closed loop with pressure increased by use of a seabed located charge pump and that the power fluid is returned to the manifold in a third header.

8. The method of claim 3, characterized in that the power fluid is separated oil pressurized by a charge pump and routed to the downhole turbine in the downhole turbine/pump hydraulic converter and that the power fluid is discharged to the well fluid brought to the manifold at the seabed.

9. A subsea petroleum production arrangement for producing hydrocarbons from a plurality of wells, comprising a manifold having a first and a second header and isolating valves for isolating the first or the second header from the respective wells, at least the first header being in selective fluid communication, via a respective adjustable valve and a respective x-mas tree, with respective hydrocarbon transporting lines in the wells, for transportation of hydrocarbons, at least one of the wells having a downhole separator for separating hydrocarbons and water and a dowrihole turbine/pump hydraulic converter for pumping separated water, characterized in that the second header is in communication with a power fluid supply line, and via a power fluid adjustable valve in further communication with a turbine in the downhole turbine/pump hydraulic converter.

10. The arrangement of claim 9, characterized in that the second header is in communication with a power fluid source on an offshore installation or onshore.

11. The arrangement of claim 9, characterized in that the second header is in communication with a power fluid source of a subterranean well.

12. The arrangement of claim 9, wherein the power fluid is water.

13. The arrangement of claim 9, wherein a subsea charge pump is provided for pressurizing the power fluid before entering the wells.

14. The arrangement of claim 13, characterized in that the second header is in communication with the surrounding seawaters, and that seawater is used as power fluid.

15. The arrangement of claim 12, wherein the discharge side of the turbine in the downhole turbine/pump hydraulic converter is in communication with the discharge side of the pump of the downhole turbine/pump hydraulic converter.

16. The arrangement of claim 15, wherein the discharge side of the turbine and the pump of the downhole turbine/pump hydraulic converter is in communication with an injection zone in a formation being injected with water.

17. The arrangement of claim 9, wherein the discharge side of the pump in the downhole turbine/pump hydraulic converter is in communication with a return line returning the power fluid to the surface or seabed.

18. The arrangement of claim 17, characterized in that the return line is in communication with a third header in communication with the charge pump, to return the power fluid to the inlet side of the charge pump.

19. The arrangement of claim 17, characterized in that the return line is in communication with the surrounding seawaters to discharge the power fluid into the seawaters.

20. The arrangement of claim 10, characterized in that a second pump is provided in the subterranean power fluid source well.

21. The arrangement of claim 20, characterized in that the second pump is an electrically driven pump.

22. The arrangement of claim 20, characterized in that the second pump is driven by a separate power fluid source.

23. The arrangement of claim 13, wherein the second pump is a downhole turbine/pump hydraulic converter, the turbine of the second downhole turbine/pump hydraulic converter being in communication with the discharge side of the charge pump.

24. The arrangement of claim 9, wherein the power fluid comprises hydrocarbons, and wherein the first header is in communication with the second header via the charge pump.

25. The arrangement of claim 24, characterized in that the discharge side of the pump of the downhole turbine/pump hydraulic converter is in communication with the hydrocarbon transporting line.

26. The arrangement of claim 9, wherein isolation valves are provided to isolate the second header from the power fluid lines and open communication between the second header and the hydrocarbon transporting lines, thereby enabling transportation of hydrocarbons in both headers.

27. The arrangement of claim 9, wherein isolation valves are provided to isolate the power fluid lines from the second header, open communication between the first header and the power fluid lines, isolate the hydrocarbon transporting lines from the first header and open communication between the hydrocarbon transporting lines and the second header, to enable hydrocarbon transport in the second header and power fluid transport in the first header or vice versa.

28. An arrangement for controlling a downhole separator, for separating hydrocarbons and water, comprising a manifold having a first and a second header and isolating valves for isolating the first or the second header from the respective wells, at least the first header being in selective fluid communication, via a respective adjustable valve and a respective x-mas tree, with respective hydrocarbon transporting lines in the wells, for transportation of hydrocarbons, at least one of the wells having a downhole separator for separating hydrocarbons and water and a downhole turbine/pump hydraulic converter for pumping separated water, characterized in that the second header is in communication with a power fluid supply, and via a power fluid adjustable valve in further communication with a turbine in the downhole turbine/pump hydraulic converter.

29. The arrangement of claim 28, characterized in that a charge pump is coupled to the second header, for pressurizing the power fluid.

30. The method of claim 3, wherein the power fluid is used to drive a turbine in a turbine/pump hydraulic converter for boosting the pressure of the production fluid or the well fluid.

31. The method of claim 30, characterized in that the power fluid is used to drive a first turbine/pump hydraulic converter for pumping separated seawater and also for driving a second turbine in a turbine/pump converter for boosting the pressure of the production fluid and that the first and second turbines are controlled by dedicated subsea adjustable valves.

32. The method of claim 30, characterized in that the power fluid is used to drive a first turbine in a turbine/pump hydraulic converter for pumping separated seawater and also for driving a second turbine in a turbine/pump converter for boosting the pressure of the production fluid and that the second turbine is controlled by a downhole adjustable valve or fixed restriction.

33. A subsea petroleum production arrangement for producing hydrocarbons from a plurality of wells, comprising a manifold having a first and a second header and isolating valves for isolating the first or the second header from the respective wells, at least the first header being in selective fluid communication, via a respective adjustable valve and a respective x-mas tree, with respective hydrocarbon transporting lines in the wells, for transportation of hydrocarbons, at least one of the wells having a downhole turbine/pump hydraulic converter, characterized in that the second header is in communication with a power fluid supply, and via a power fluid adjustable valve in further communication with a turbine in the downhole turbine/pump hydraulic converter and that the pump of the turbine/pump hydraulic converter is pumping well fluid or production fluid.

34. The arrangement of claim 33, wherein a respective dedicated subsea adjustable valve is provided in the power fluid line for the turbine of the turbine/pump converter pumping well fluid or production fluid and the turbine of the turbine/pump converter pumping separated water.

35. The arrangement of claim 33, wherein a downhole adjustable valve or fixed restriction is provided in the power fluid line for the turbine of the turbine/pump converter pumping well fluid or production fluid.

36. The method of claim 1, wherein the water from the pump in the downhole turbine/pump hydraulic converter is used for injection in the formation.

37. The method of claim 1, wherein surrounding seawater is used as power fluid and is either injected into the reservoir together with the separated produced water or returned to the seabed and discharged to the surrounding sea.

38. The method of claim 1, wherein the power fluid is extracted from a formation and is free flowing from an aquifer to the seabed or pumped to the seabed using a downhole electrical operated pump or a downhole turbine/pump hydraulic converter.

39. The method of claim 1, wherein the power fluid is circulated in a closed loop with pressure increase by use of a seabed located charge pump and wherein the power fluid is returned to the manifold in a third header.

40. The method of claim 1, wherein the power fluid is separated oil pressurized by a charge pump and routed to the downhole turbine in the downhole turbine/pump hydraulic converter and wherein the power fluid is discharged to the well fluid brought to the manifold at the seabed.

41. The arrangement of claim 20, wherein the second pump is a downhole turbine/pump hydraulic converter, the turbine of the second downhole turbine/pump hydraulic converter being in communication with the discharge side of the charge pump.

42. The arrangement of claim 13, wherein the power fluid comprises hydrocarbons and wherein the first header is in communication with the second header via the charge pump.

43. The arrangement of claim 9, wherein a respective dedicated subsea adjustable valve is provided in the power fluid line for the turbine of the turbine/pump converter pumping well fluid or production fluid and wherein the turbine of the turbine/pump converter pumps separated water.

44. The arrangement of claim 26, wherein a respective dedicated subsea adjustable valve is provided in the power fluid line for the turbine of the turbine/pump converter pumping well fluid or production fluid and wherein the turbine of the turbine/pump converter pumps separated water.

45. The arrangement of claim 27, wherein a respective dedicated subsea adjustable valve is provided in the power fluid line for the turbine of the turbine/pump converter pumping well fluid or production fluid and wherein the turbine of the turbine/pump converter pumps separated water.

46. The arrangement of claim 9, wherein a downhole adjustable hole or fixed restriction is provided in the power fluid line for the turbine of the turbine/pump converter pumping well fluid or production fluid.

47. The arrangement of claim 26, wherein a downhole adjustable hole, or fixed restriction is provided in the power fluid line for the turbine of the turbine/pump converter pumping well fluid or production fluid.

48. The arrangement of claim 27, wherein a downhole adjustable hole or fixed restriction is provided in the power fluid line for the turbine of the turbine/pump converter pumping well fluid or production fluid.

* * * * *